US006652035B2

(12) United States Patent
Chisholm

(10) Patent No.: US 6,652,035 B2
(45) Date of Patent: Nov. 25, 2003

(54) HIGHWALL MINING SYSTEM

(75) Inventor: John W. Chisholm, Antigonish (CA)

(73) Assignee: Nova Construction Company Limited, Nova Scotia (CA)

( * ) Notice: Subject to any disclaimer, the term of this patent is extended or adjusted under 35 U.S.C. 154(b) by 38 days.

(21) Appl. No.: 10/008,168

(22) Filed: Dec. 5, 2001

(65) Prior Publication Data

US 2003/0042784 A1 Mar. 6, 2003

(30) Foreign Application Priority Data

Aug. 30, 2001 (CA) ..... 2356731
Sep. 13, 2001 (CA) ..... 2357274

(51) Int. Cl.[7] ..... E21C 41/00; E21C 35/00; E21C 47/00

(52) U.S. Cl. ..... 299/18; 299/56; 299/67

(58) Field of Search ..... 175/62; 299/18, 299/19, 56, 64, 67, 76

(56) References Cited

U.S. PATENT DOCUMENTS

| | | | | |
|---|---|---|---|---|
| 5,112,111 A | | 5/1992 | Addington et al. | |
| 5,232,269 A | | 8/1993 | Addington et al. | |
| 5,261,729 A | | 11/1993 | Addington et al. | |
| 5,364,171 A | | 11/1994 | Addington et al. | |
| 5,692,807 A | * | 12/1997 | Zimmerman | 299/67 |
| 5,863,101 A | * | 1/1999 | Seear | 299/68 |

FOREIGN PATENT DOCUMENTS

| | | |
|---|---|---|
| CA | 2075619 | 6/1992 |
| CA | 2075638 | 6/1992 |
| CA | 2203625 | 5/1996 |
| CA | 2205596 | 5/1996 |
| CA | 2263216 | 9/1999 |
| CA | 2263251 | 9/1999 |

OTHER PUBLICATIONS

"Highway Evolution", Simon Walker, World Coal, Oct. 1997, pp. 1–9.

"Highwall Mining Using the Addcar System", Mining Technologies, Inc., SME Meeting, Oct. 27, 1999.

"High–Wall Mining Technology for surface Coal Mines", Nova Scotia Minerals Update, Summer 2000.

"Code of Practice—Highwall Mining System"—portion of submission to Nova Scotia Dept. of Labour incl.—"Introduction to a Typical Highwall Mining System", pp. 1–9, "Highwall Mining System Components", pp. 10–11 and "Operation", pp. 12–17. (Date and extent of any publication—unknown).

* cited by examiner

*Primary Examiner*—David Bagnell
*Assistant Examiner*—Brian Halford
(74) *Attorney, Agent, or Firm*—John W. Ross

(57) ABSTRACT

A highwall mining system of the type wherein multiple conveyor cars are connected together to form a conveyor train which extends into a seam being mined by a mechanical miner located at the inner end of the conveyor train is capable of effective operation in steep dip seams, e.g. up to about 30°, and is constructed so that it can be quickly disassembled, moved, and reassembled and put into operation with minimal downtime.

25 Claims, 21 Drawing Sheets

HIGHWALL MINING SYSTEM

BACKGROUND OF THE INVENTION

This invention relates to a highwall mining system of the type wherein multiple conveyor cars are connected together to form a conveyor train which extends into a seam being mined by a mechanical miner located at the inner end of the conveyor train.

It is well known that high wall mining systems enable relatively efficient mining of near surface coal seams with a reduced cost of excavation, high yield, and reduced environmental damage.

Under highwall methodology the surface is excavated to the level of the coal seam as with a typical surface mine. A vehicle, sometimes typically referred to as a "launch vehicle" is set in place adjacent to the exposed wall of the seam and on the same inclination angle as the seam. From the launch vehicle, a mining apparatus (hereafter called a "miner") is launched into the seam. The miner used in typical high wall operations is similar or identical to equipment which is employed in traditional underground coal mines, and includes a cutter apparatus which moves up and down the coal face. Conveyor sections carry the cut coal from the miner to the launch vehicle. Propulsion cylinders contained in the launch vehicle push the mining apparatus horizontally into the coal seam and withdraw the apparatus once mining is complete. As the mining equipment proceeds into the seam, conveyor sections are added which, as noted above, convey the coal back from the miner to the launch vehicle from where it is conveyed elsewhere in the mine. The miner may penetrate the seam for a length up to approximately 1000 feet.

A key element of highwall mining is that no personnel are required to enter the coal seam. It is important that the mining operation be completed and the equipment withdrawn quickly as no roof support is employed. Video imaging of the mining operation is typically maintained by a series of cameras in the area of the miner, which is viewed by the operators at the launch vehicle. When the miner is in operation, a series of cables extend from the launch vehicle into the mining apparatus and the conveyors. The vertical reach of the cutters on the mine varies, depending upon the size of the miner.

There are a variety of highwall mining systems currently on the market, some of which have been reasonably successful while others have been less so. It appears that few, if any, of the current available systems are effective in mining seams having relatively high slopes, e.g. slopes up to about 30°.

Consequently, there is a need for a highwall mining system capable of effective operation in steep dip seams, e.g. up to about 30°.

The existing prior art systems are also, in general, relatively cumbersome to move from one location to another. Often, relocation requires substantial dismantling of these complex systems over a time span of several days. Consequently, there is a need to provide a transportable highwall mining system which can be disassembled, moved, and reassembled by personnel in a matter of hours.

SUMMARY OF THE INVENTION

It is a general objective of the invention to provide an improved highwall mining system capable of alleviating the several problems briefly noted above.

A highwall mining system particularly suitable for steep dip seams and of the type wherein multiple conveyor cars are connected together to form a conveyor train which extends into a seam being mined in accordance with one aspect of the invention comprises:

(a) an elongated launch vehicle having a launch deck for receiving and supporting a conveyor car which is to be added to or removed from an outer end of the conveyor train when in operation, said launch deck having a conveyor belt running lengthwise thereof and extending to an aft end of said launch vehicle;

(b) a plurality of conveyor cars forming the conveyor train and adapted to convey mined material outwardly to the conveyor belt of said launch deck;

(c) a miner attached to an inner end of said conveyor train for cutting material from the seam being mined and moving it to the inner end of the conveyor train for conveyance by the latter outwardly to said launch deck; and (d) a pair of extendible support columns secured to an aft end portion of said launch deck in flanking relation thereto and having hydraulic cylinders associated therewith to effect controlled lifting and lowering of said aft end of the launch deck and to tilt the latter in a vertical plane as desired to accommodate the dip angle of the seam to be mined.

A further pair of extendible support columns is preferably secured to a forward end portion of said launch deck in flanking relation thereto and having hydraulic cylinders associated therewith for effecting controlled lifting and lowering of the forward end portion to effect substantial alignment of the launch deck with an exposed face of the seam.

The support columns at the aft end of the launch deck are preferably pinned to opposing sides of said launch deck aft end portion to allow pivotal motion of said support columns relative to said deck, said launch vehicle having stops to limit the degree of said pivotal motion of the aft end support columns.

The launch deck may advantageously be further equipped with a pair of laterally spaced stabilizing cylinders each located at the forward end of the deck in alignment therewith and capable of being extended forwardly of said deck and into engagement with parts of the highwall formation being mined to assist in securing and stabilizing the launch vehicle during operation.

Skid tracks may be located below the lower ends of both the forwardly and the rearwardly located pairs of support columns, each skid track extending laterally of the launch deck and adapted to be supported on the earth when in use, and an elongated skid cylinder connected between each skid track and an associated lower end of each pair of support columns such that either or both of the fore and aft ends of the launch vehicle can be shifted laterally and the launch vehicle angularly adjusted as desired in a horizontal plane.

The lowermost ends of said support columns preferably each have a foot mounted thereto via a pivot pin extending parallel to the associated skid track such that forces on said launch vehicle tending to displace the latter rearwardly cause said feet and said tracks to tilt slightly and dig in to the earth to resist movement.

A highwall mining system particularly suitable for steep dip seams and of the type wherein multiple conveyor cars are connected together to form a conveyor train which extends into a seam being mined in accordance with a further aspect of the invention comprises:

(a) an elongated launch vehicle having a launch deck for receiving and supporting a conveyor car which is to be added to or removed from an outer end of the conveyor train when in operation;

(b) said launch deck having a conveyor belt running lengthwise thereof to receive mined material which has been transported along the conveyor train and to convey and discharge said material from the rear or aft end of the launch vehicle;

(c) a miner for cutting material from the seam being mined and moving it to an inner end of the conveyor train;

(d) a plurality of conveyor cars connected end to end to define said conveyor train and extending, when in use, from said miner at an inner or front end of the train rearwardly to a last conveyor car on said launch deck, each conveyor car having a powered conveyor belt with said belts of the cars in the conveyor train being in closely adjacent relation to each other to provide continuity of conveyance of the mined material for discharge thereof onto the conveyor belt of the launch deck;

(e) a pair of elongated hydraulic conveyor car drive cylinders mounted to said launch deck in parallel relation to a last said conveyor car when supported on said launch deck, said conveyor car drive cylinders each including a ram having activatible conveyor car engaging devices thereon such that actuation of said drive cylinders in conjunction with said engaging devices causes said conveyor cars to be advanced into a seam being mined or to be retraced therefrom as desired.

In a preferred embodiment each of said conveyor cars has engagement lugs on opposing sides thereof each said lug having a socket therein, said conveyor car engaging devices on the rams of said drive cylinders including male pin members adapted to enter said sockets of the engagement lugs of the last conveyor car on said launch deck to enable transmittal of forces from said drive cylinders via said engagement lugs to said conveyor car and thence to the entire conveyor train; and an actuator associated with each of said male pin members to effect their advancement into said sockets of the lugs and withdrawal therefrom whereby as said drive cylinders are advanced and retracted said conveyor train is advanced or retracted as desired.

The launch deck further preferably includes a staging cylinder having a ram movable into and out of engagement with the last conveyor car of said train to assist in effecting any desired motion of same lengthwise of said deck in the course of loading and unloading of the conveyor cars to and from said deck to facilitate connecting said last conveyor car to the next adjacent conveyor car or disconnecting same.

Stop cylinders may be mounted to said launch deck and capable of being advanced into engagement with a next-to-last conveyor car of the conveyor train to prevent unwanted motion of the train back into a sloping seam at those intervals of time when said conveyor car engaging devices are not engaged with said next-to-last car.

A transportable launch vehicle for a highwall miner having multiple elongated conveyor cars that may be connected together to form a conveyor train, in accordance with a further aspect of the invention comprises:

(a) an elongated launch deck for receiving and supporting a conveyor car which is to be added or removed from an end of the conveyor train when in operation;

(b) an upper equipment deck disposed, in use, in connected and spaced relation above said launch deck;

(c) fore and aft pairs of extendible support columns secured to said launch deck in flanking relation thereto and having hydraulic cylinders associated therewith for tilting and changing the elevation of the entire launch vehicle as required to accommodate the dip angle and location of the face of a seam to be mined;

(d) fore and aft pairs of outrigger legs attached to fore and aft end portions of said upper deck for temporarily supporting the latter above said launch deck such as to allow the launch deck to be removed from beneath said upper deck for transport purposes;

(e) said outrigger legs being extendible and retractable such that after removal of the launch deck, and on retraction thereof, said upper deck may be lowered onto a suitable transport device, said outrigger legs being removed during transportation and, following transport to a desired location, the outrigger legs may be reattached and extended to raise said upper deck thus allowing said launch deck to be again relocated therebeneath and reconnected in said spaced relation thereto.

Preferably said fore and aft pairs of support columns are detachable from said upper and launch decks respectively to permit ready transport of said decks.

Still further said launch deck may be provided with detachable wheel and axle sets to permit the launch deck to be towed away from beneath the upper deck.

In a preferred embodiment, uprights are connected between said upper and launch decks for securing them in said spaced relation during normal use. When the outriggers are in place and extended they provide temporary support to the upper deck and allow it to be lowered downwardly.

A further aspect of the invention provides a method of conversion between transport and operating modes of a transportable launch vehicle for a highwall miner of the type having multiple elongated conveyor cars that may be connected together to form a conveyor train, wherein said launch vehicle comprises an elongated launch deck for receiving and supporting a conveyor car which is to be added or removed from an end of the conveyor train when in operation, and an upper equipment deck fixed, in use, in spaced relation above said launch deck; said method comprising:

(a) providing fore and aft pairs of extendable and retractable outrigger legs at fore and aft end portions of said upper deck for temporarily supporting the latter above said launch deck;

(b) disconnecting the upper deck from the launch deck;

(c) removing the launch deck from beneath said upper deck for transport purposes when said legs are in an extended condition;

(d) retracting said outrigger legs to lower said upper deck downwardly onto a suitable transport device;

(e) transporting said decks to a desired location;

(f) extending said outrigger legs to raise said upper deck; and (g) positioning said launch deck beneath said upper deck and reconnecting the decks in said spaced relation.

In the preferred form of the invention the outrigger legs are removed prior to step (e) above and reattached after step (e).

The method may include providing said launch deck with detachable wheel and axle sets to permit the launch deck to be towed away from beneath the upper deck.

When said outriggers are in place they provide temporary support to the upper deck when the launch deck is being removed from or positioned beneath said upper deck. The outriggers are normally removed prior to the start of actual mining operations.

Further features and advantages of the invention will be apparent from the following description and the appended claims.

DETAILED DESCRIPTION OF THE PREFERRED EMBODIMENTS

Figure 1:
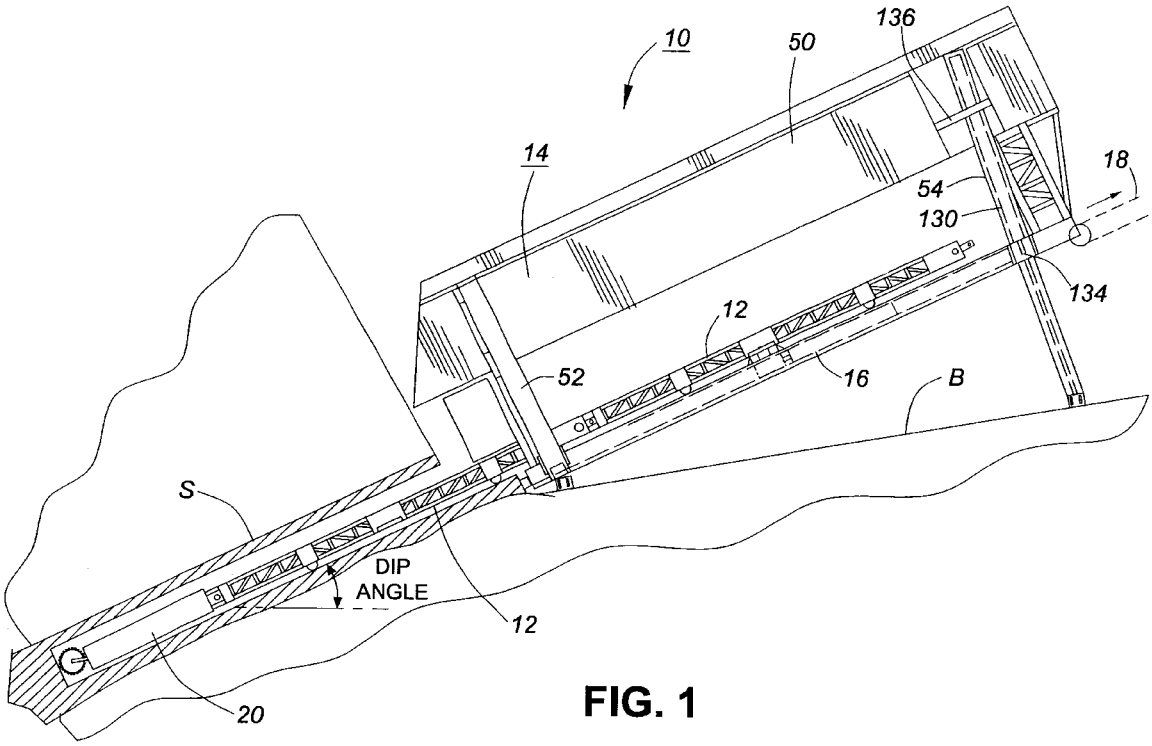
FIG. 1 is a side elevation view of the highwall mining system in accordance with an embodiment of the present invention.

Referring now to the drawings, there is shown a highwall mining system 10 which is particularly useful and adapted for operations on coal seams having a steep dip angle. The mining system includes multiple conveyor cars 12 connected together to form an elongated conveyor train which is capable of extending into a seam S of coal or other suitable material to be mined. As shown, the system includes an elongated launch vehicle 14 having a launch deck 16 for receiving and supporting a conveyor car 12 which is to be added to or removed from an outer end of the conveyor train when the mining system 10 is in operation. As will be described in greater detail hereafter, the launch deck 16 has a conveyor belt running lengthwise of same to receive coal which has been transported along the conveyor train and to convey and discharge the coal from the rear of the launch vehicle 14. A suitable discharge or stacking conveyor 18 carries the coal away from the rear of the launch vehicle and may, as desired, discharge the coal into suitable containers or alternatively simply allow the coal to build up as a pile on the ground.

Figure 5:
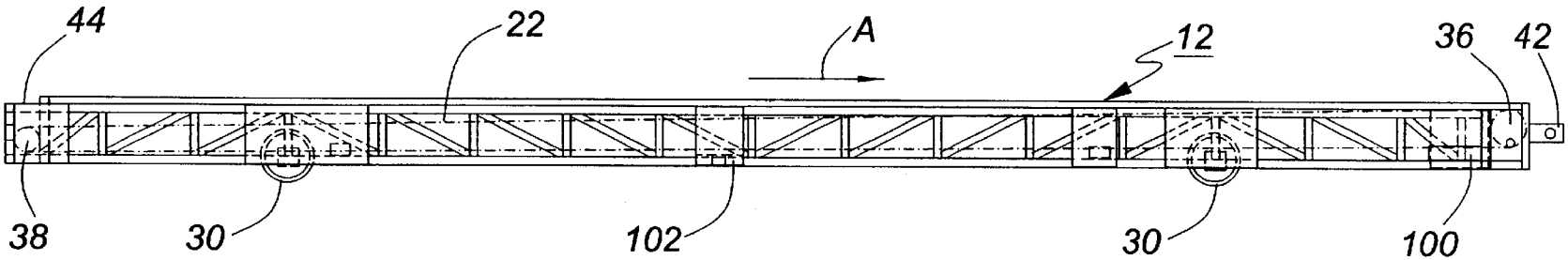
FIG. 5 is a side elevation view of the conveyor car.
Figure 7:
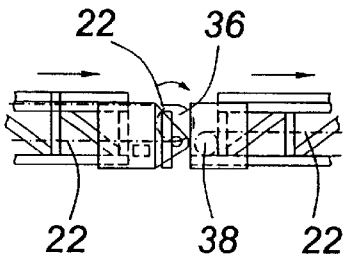
FIG. 7 is a partial side elevation view showing car-to-car conveyor overlap.
Figure 6:
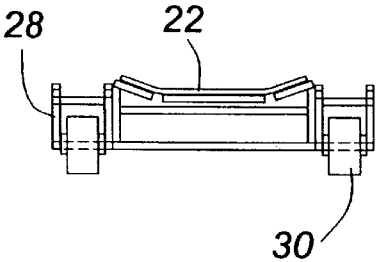
FIG. 6 is a typical cross-section view of a conveyor car.

A multiplicity of conveyor cars 12 are connected fairly rigidly end-to-end, as will be hereinafter described, and this train of conveyor cars extends, when in use, from a miner 20 which is located at the inner or head end of the train, rearwardly and outwardly to a last conveyor car 12 positioned on the launch deck 16. Each conveyor car has its own powered conveyor belt 22 (FIG. 5), the belts of the conveyor cars in the conveyor train being sufficiently adjacent or overlapped with each other at the adjoining ends of the conveyor cars (FIG. 7) so that the mined coal can be conveyed in an uninterrupted matter from one conveyor car to the next until such coal is discharged onto the conveyor belt 73 provided in the launch deck 16.

Figure 8A:
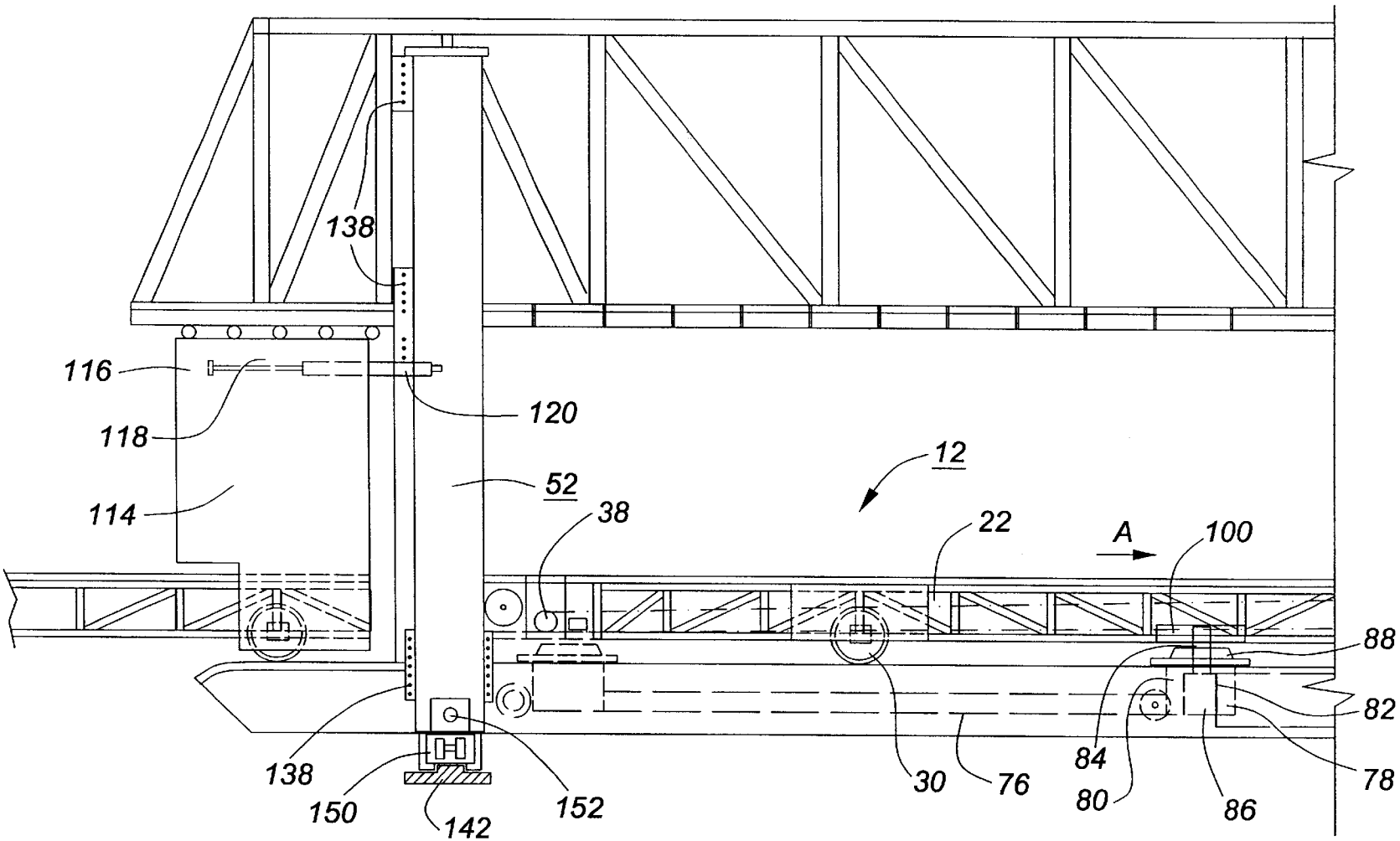
FIGS. 8A, 8B is a side elevation view of the launch vehicle showing the upper and launch decks in spaced parallel relation.
Figure 8B:
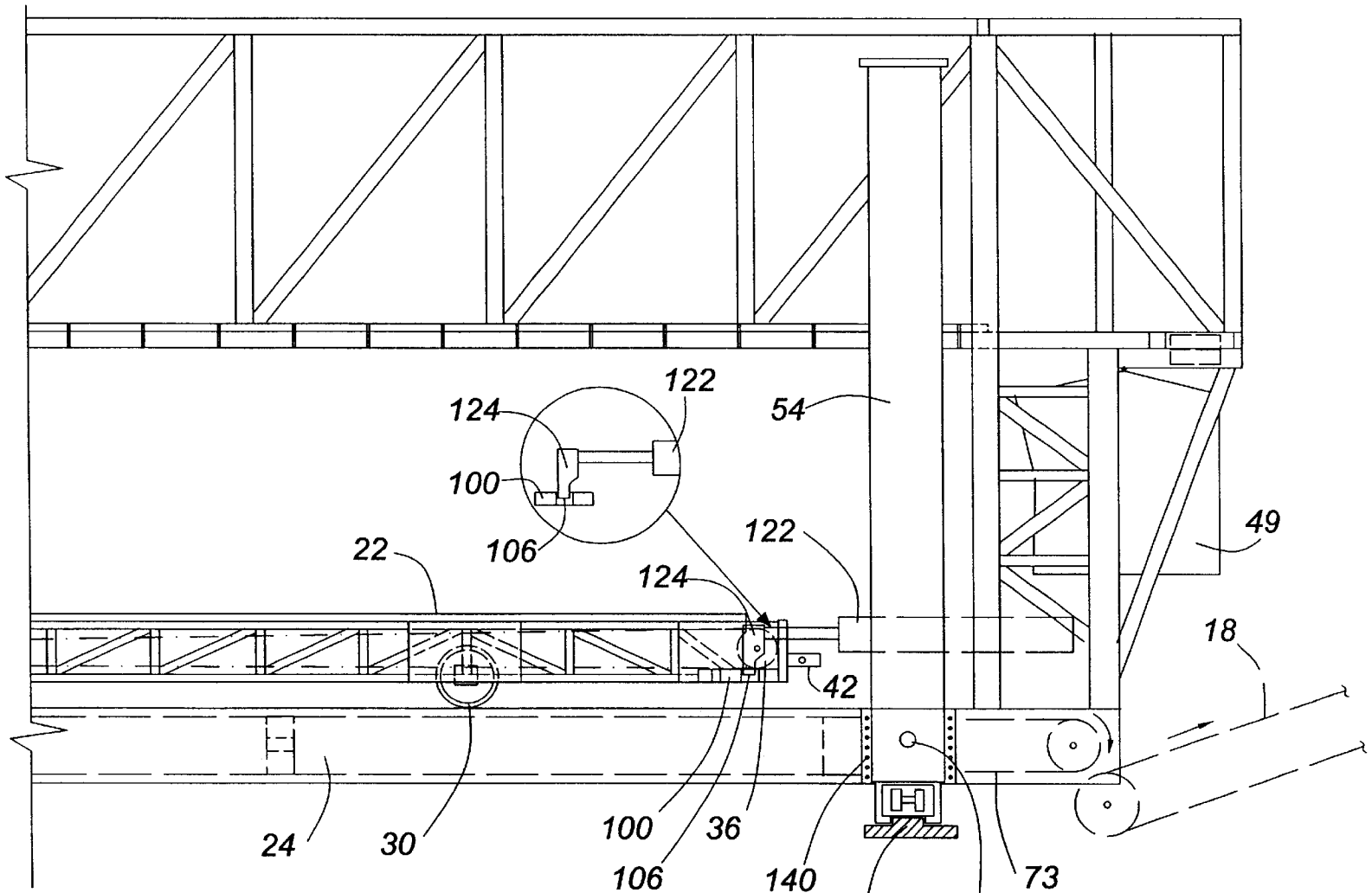
Figure 9A:
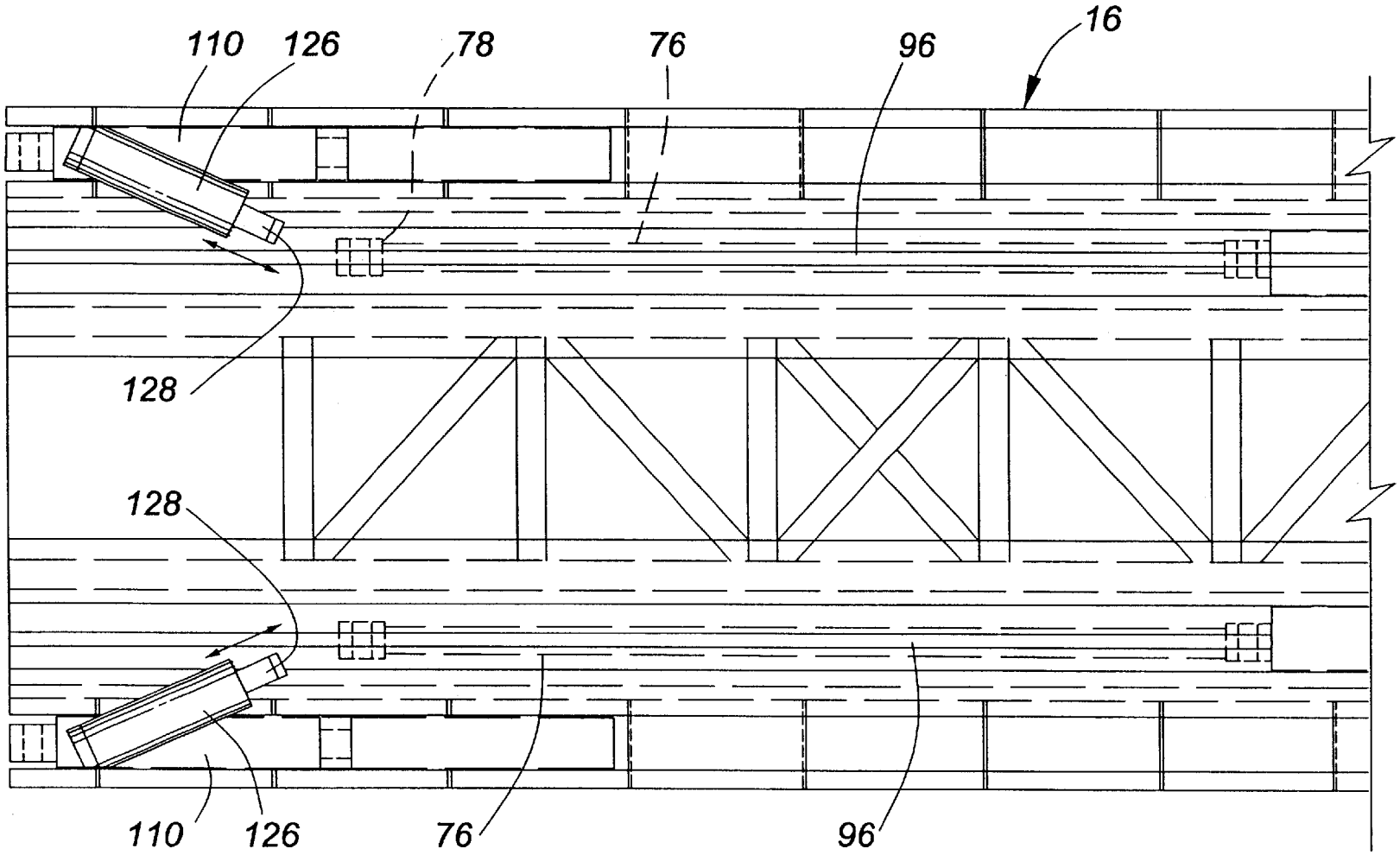
FIGS. 9A, 9B is a plan view of the launch deck showing the structural layout together with the conveyor car drive cylinders, the highwall engaging cylinders and the stop and staging cylinders.
Figure 9B:
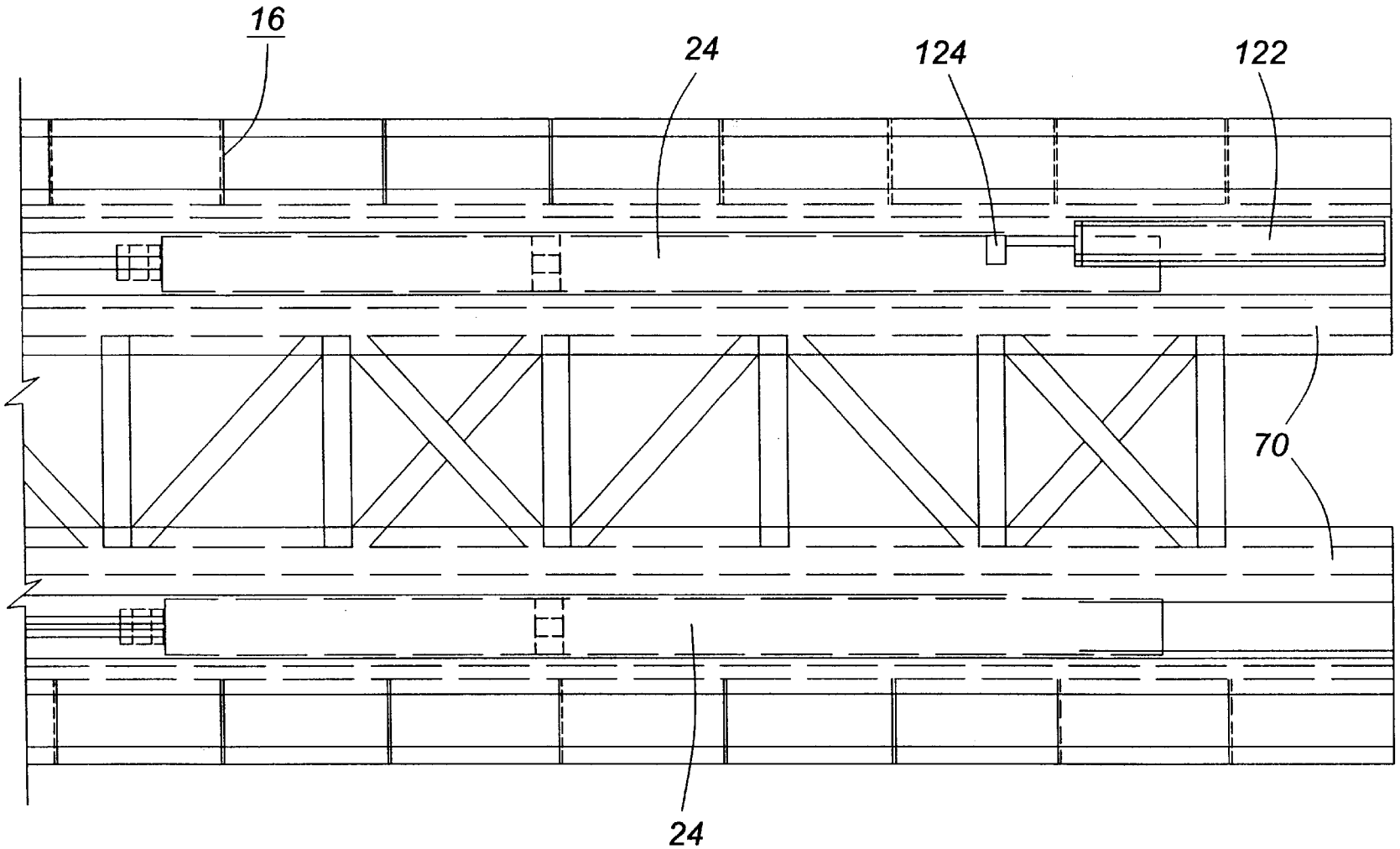
Figure 10:
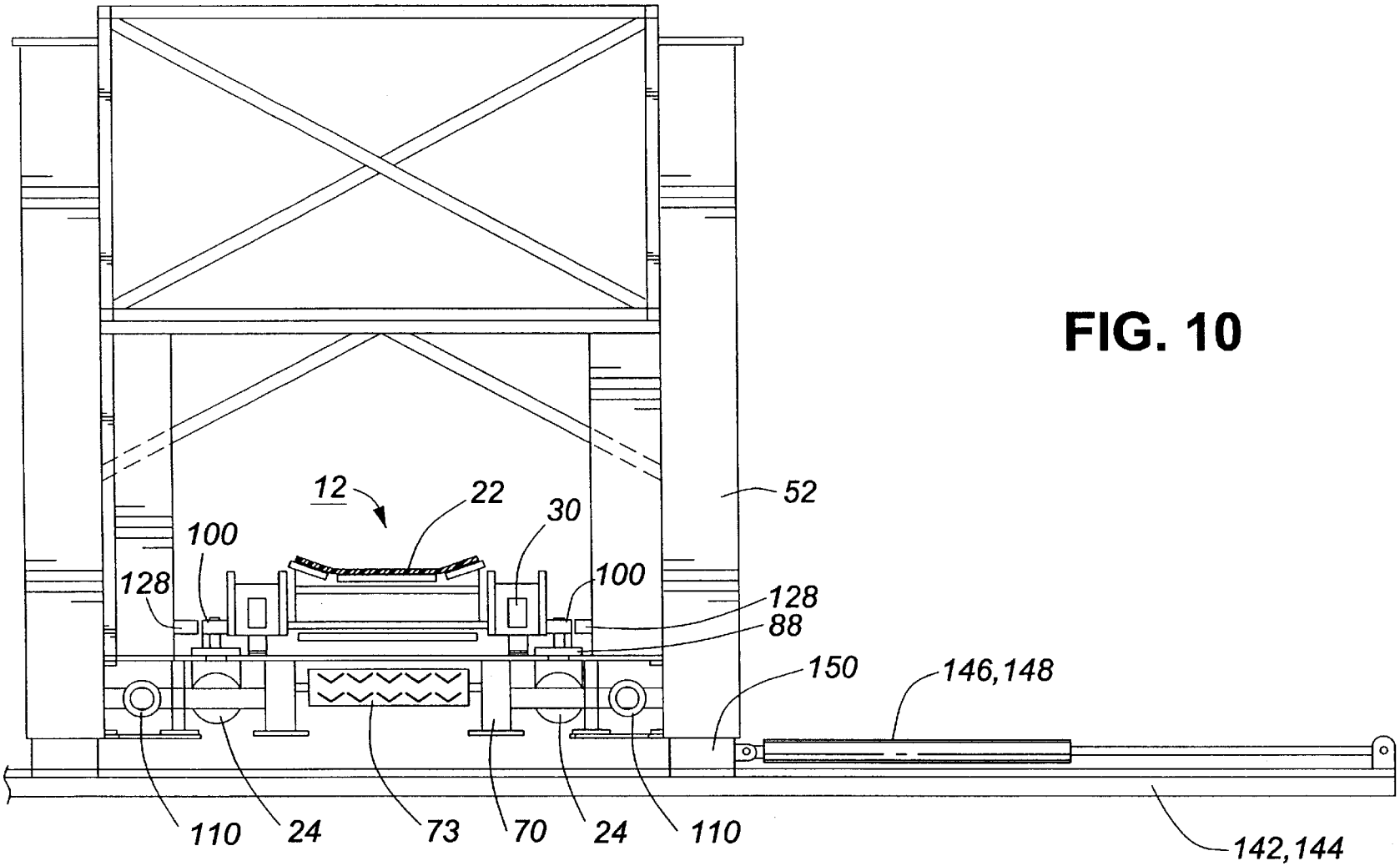
FIGS. 10 and 11 are highwall end and conveyor end elevation views respectively of the launch vehicle (with a conveyor car mounted thereon)
Figure 11:
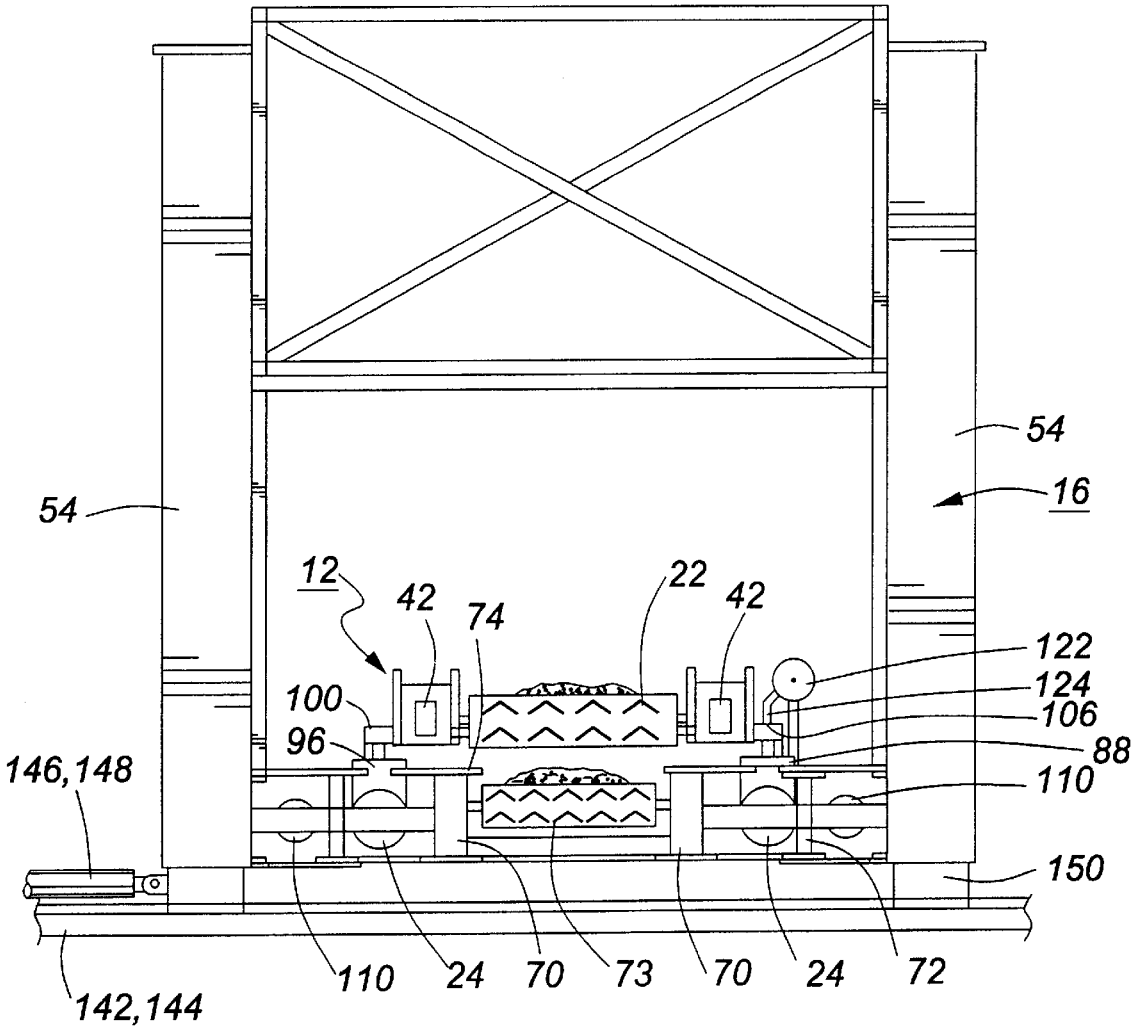

A pair of elongated hydraulic conveyor car drive cylinders 24 (FIG. 8) are mounted to the launch deck 16 at opposing sides thereof and arranged so as to be in flanking relation to the last or outermost conveyor car 12 positioned on the launch deck. These conveyor car drive cylinders each include a ram having an activatible conveyor car engaging device 78 (described hereafter) mounted to the distal end thereof. When the conveyor car engaging devices 78 are actuated to connect to the car, and the drive cylinders 24 are actuated, they push the train of conveyor cars into the seam being mined, or in reverse operation, pull or retract the train of cars out of the seam.

The miner 20, is located at the inner or head end of the conveyor train and is of a type well-known in the art, for example, a Joy miner. As is well-known, the miner includes a rotating cutter head drum for supporting a series of cutting bits. The cutter head drum is rotatably mounted on arms that are pivotally mounted to the main frame of the miner. The main frame of the miner is supported for movement along the floor of the mine by a pair of skids. In operation, the miner 20 is advanced into the face of the coal seam S, and the cutter head drum is made to rotate. As the miner advances, the arms are pivoted thus causing the rotating cutter head to be raised and lowered, in consequence of which coal is cut from the face of the seam S by the cutting bits. The aggregate coal is then delivered by the miner to the lead conveyor car of the above-mentioned conveyor train whereby to convey the coal outwardly along the train in the fashion generally described previously.

The miner may be equipped with one or more video cameras (not shown) to allow the operator to view the operation of the miner from an operator's cabin mounted to the launch vehicle as will be hereinafter described.

As best shown in FIGS. 4 to 11 each conveyor car 12 comprises a main structural frame 28 supported for longitudinal movement on pairs of ground engaging wheels 30. The main structural frame comprises a pair of laterally-spaced apart parallel built-up beams 32 of welded construction designed to withstand the very substantial bending moments which would be imposed on the conveyor cars if, for example, a substantial section of the mine roof were to collapse on it. The upper surfaces of the beams 32 define shallow U-shaped troughs 33 which house the electrical cables and other conduits (not shown) which supply the miner 20. These troughs 33 match the troughs of adjacent conveyor cars and thus run the full length of the conveyor train. Each conveyor car 12 includes a longitudinally extending slightly inclined conveyor belt 22 which is located between the built-up beams 32 of the structural frame. The conveyor belt 22 operates so as to convey the coal received at the low end to the high end where it is discharged from the conveyor car. It will be appreciated that the coal is conveyed along each conveyor car 12 in the direction as shown by the arrows A in FIGS. 5 and 8.

Each conveyor car 12 also includes its own drum motor 36 for driving the conveyor belt. The drum motor 36, typically a 30 HP motor, provides a relatively large diameter pulley at the high end of the conveyor while a smaller diameter idler drum 38 is located at the opposite end of the conveyor car. In addition to the mechanical connections between the conveyor cars to be described hereinafter, all of the conveyor cars 12 are connected together electrically such that power from a power source located in the launch vehicle 14 may be supplied to the drum motors 36 of all of the individual conveyor cars 12 for simultaneous operation at a substantially consistent speed. Each conveyor car 12 is preferably provided with an individual motor control system (not shown), again preferably by Joy, such system being designed to provide a sequential start after conveyor shutdown thereby providing for a five-second delay between conveyor startups for each successive conveyor car 12 in the train beginning with the outermost conveyor car thereby to avoid buildup and overloading of the conveyor system.

The conveyor belts 22 used, particularly where relatively steep slopes are involved, are those made by CFM Industries (an Irving company). It will be seen in FIGS. 10 and 11 that these belts employ spaced-apart raised chevrons on their surfaces, which engage the aggregate coal and effectively move it along even in the case of inclines as high as 30° from the horizontal.

Each of the conveyor cars 12 also includes coupling devices 40 at its opposing ends which are designed to allow the conveyor cars to be securely and relatively rigidly coupled together and also for the lead conveyor car (which is made one-half the length of the remaining conveyor cars) to be coupled to the miner 20. These coupling devices 40 connect the conveyor cars together sufficiently rigidly as to allow the conveyor train to be pushed forwardly into the seam S being mined while at the same time avoiding substantial deviation of the conveyor train from a straight-line path as seen in a horizontal plane. Accordingly, each conveyor car 12 has at its aft end, a pair of laterally-spaced apart rectangular lugs 42, each partially housed within and projecting outwardly from an end of a respectively associated built-up beam 32 while at the opposing end of each conveyor car the ends of the built-up beams 32 are provided with welded steel box constructions 44 serving to define rectangular pockets (not shown) each adapted to closely receive a respective one of the coupling lugs 42 of the next adjacent conveyor car. When the conveyor cars 12 are brought into close abutting end-to-end relationship with one another, the coupling lugs 42 of the one conveyor car enter into the pockets of the adjoining conveyor car. At this point a pair of coupling pins 46 are inserted through mating apertures 48 provided in the aforementioned pockets and in the coupling lugs 42 thereby to secure the conveyor cars 12 together in the semi-rigid fashion noted above. However, since a small amount of angular movement of one conveyor car relative to another in a vertical plane is considered desirable, one or both of the apertures extending through the coupling lugs 42 may be made of oval shape, with the long axis of the oval being vertically oriented thereby to permit a small degree of relative vertical motion of one conveyor car end relative to the other (usually not more than a fraction of an inch relative motion). The coupling pins 46 are each provided with suitable locking means (not shown) whereby to preclude accidental displacement and loss during the course of operation.

It will thus be appreciated that when the conveyor cars 12 are connected together by means of the coupling devices 40 described above, the conveyor cars tend to remain in a relatively straight line behind the miner 20 during the course of operation. This is of some importance, since as many as twenty-five 40-foot long conveyor cars 12 may be connected together to satisfy the objective of mining a seam along a length of about 1000 feet. At the same time, by providing the small degree of eccentricity in the apertures 48 of the coupling devices 40 referred to above, a small degree of angular motion in a vertical plane between adjacent conveyor cars is permitted thus allowing the conveyor train to follow slight contours as may be dictated by the seam being mined. Also, the substantial rigidity of the conveyor train referred to above coupled with the fact that the miner 20 is supported on the skids ensures good lateral control thus ensuring that mining is completed in a relatively straight line while avoiding the need for expensive remote control guidance systems.

The aforementioned launch vehicle 14 will now be described in some detail. As shown in the drawings, the launch vehicle is supported on a bench B (FIG. 1), which bench B is typically undercut below the bottom of the seam S to receive the launch vehicle. The bench may be inclined to reduce the length that the support legs must be extended as discussed hereafter. The launch vehicle 14 includes the previously-noted elongated launch deck 16 for receiving and supporting a conveyor car 12 which is to be added to or removed from the outer end of the conveyor train during operation. Launch vehicle 14 also includes an upper equipment deck 50 which in use is arranged in spaced parallel relation above the launch deck 16. Also included are fore and aft pairs of extendible support columns 52, 54 secured to the launch vehicle in flanking relation to it. Each support column comprises a pair of hollow rectangular sections arranged in telescoping relation to each other to provide extensibility. Each such support column has an elongated hydraulic cylinder 130 (FIG. 1) disposed therein which can be activated for changing the column lengths and tilting and changing the elevation of the entire launch vehicle 14 as required to accommodate the dip angle and location of the face of the seam S to be mined.

Figure 3:
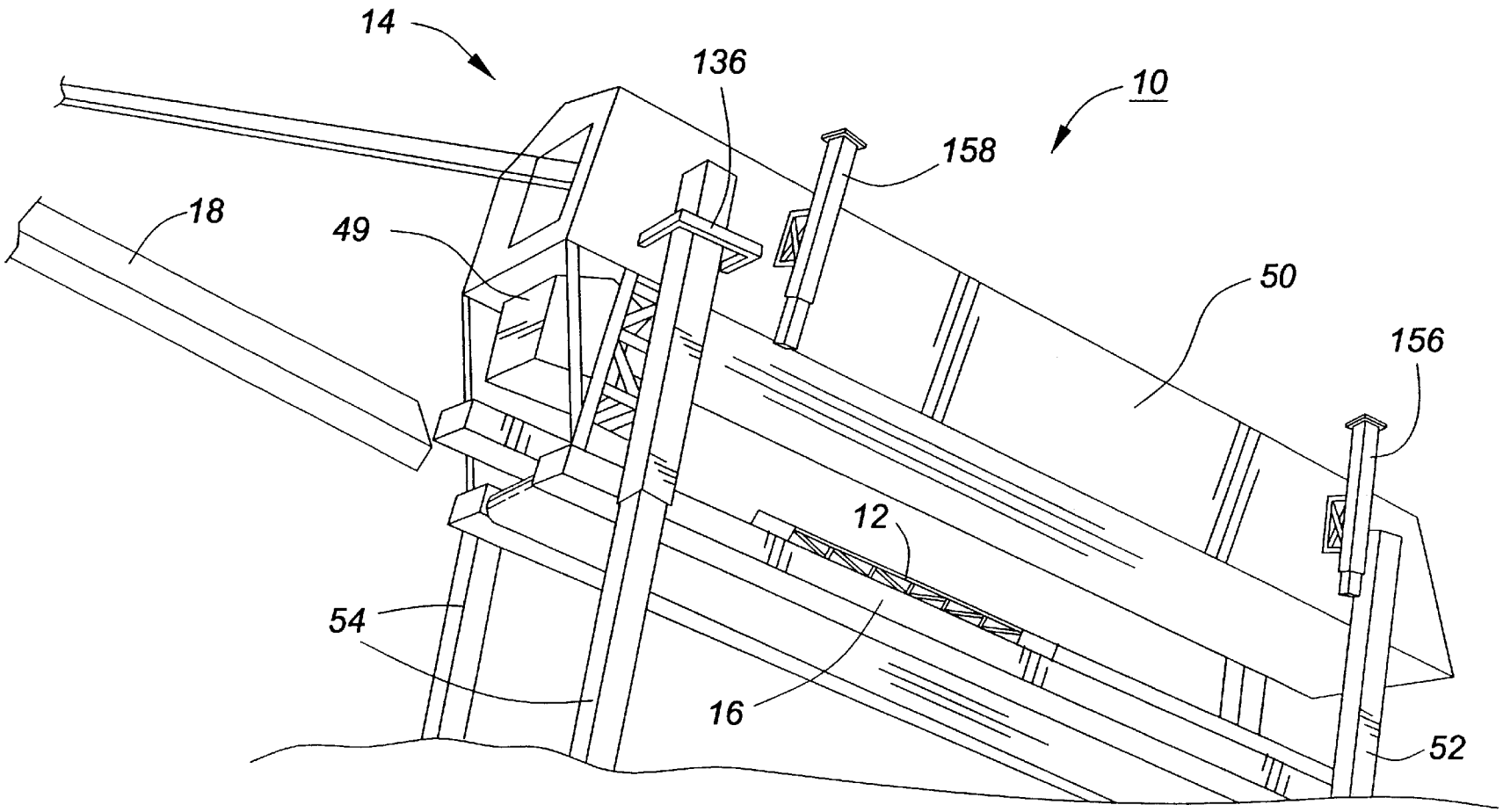
FIG. 3 is a perspective view of the mining system in an inclined position prior to commencing operations (it being noted that the outrigger legs are removed prior to normal mining operations)
Figure 4:
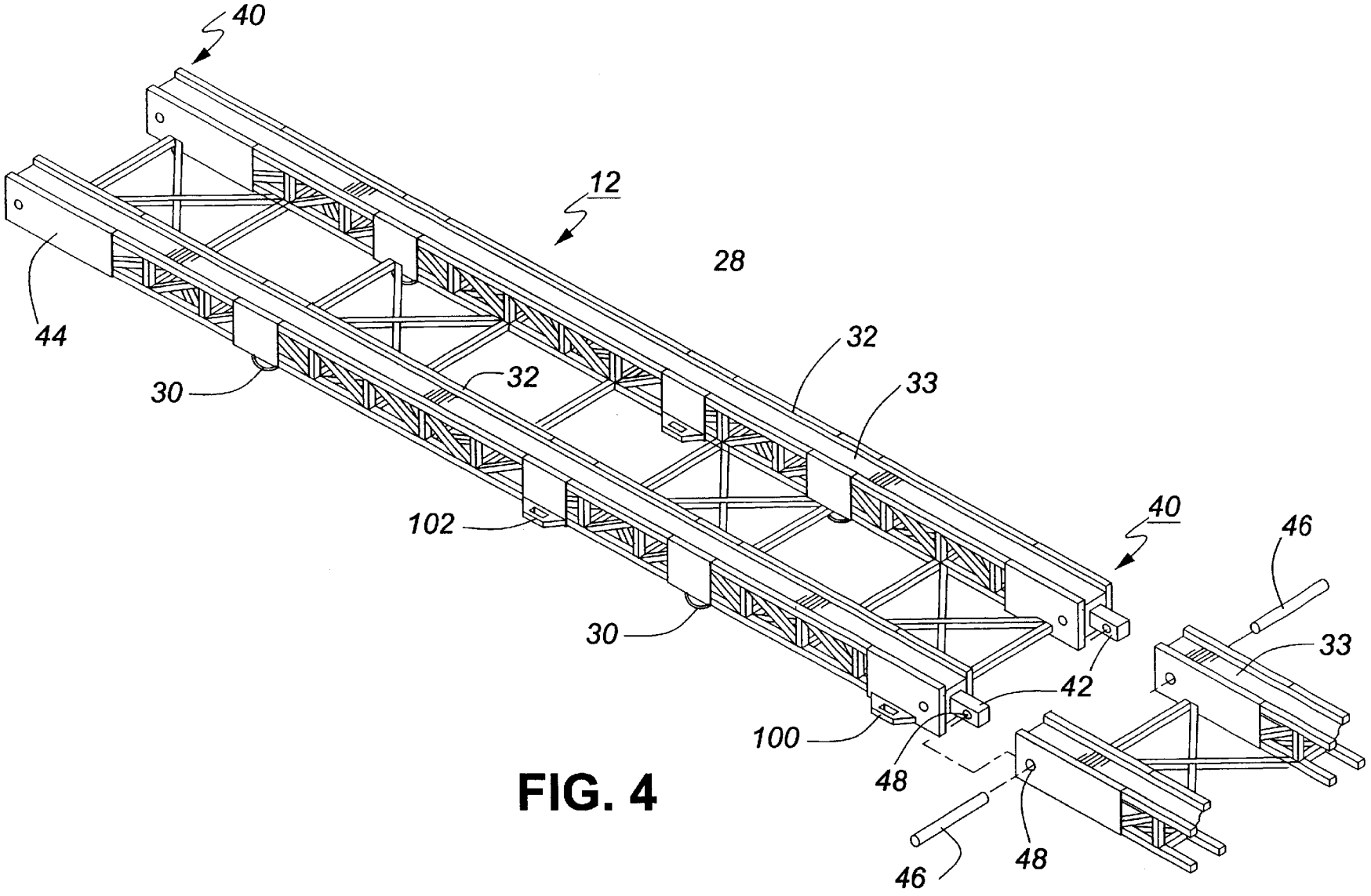
FIG. 4 is a perspective view of a typical conveyor car framework (conveyor belt and rollers omitted)

A small operator's cabin 49 (FIG. 3) is pivotally suspended at the aft end of the launch deck 16 by a suitable gimbal device (not shown) so that cabin 49 remains level regardless of seam and equipment slope. This cabin contains the operator's controls, video monitors and the like, none of which need be described in detail.

Figure 2:
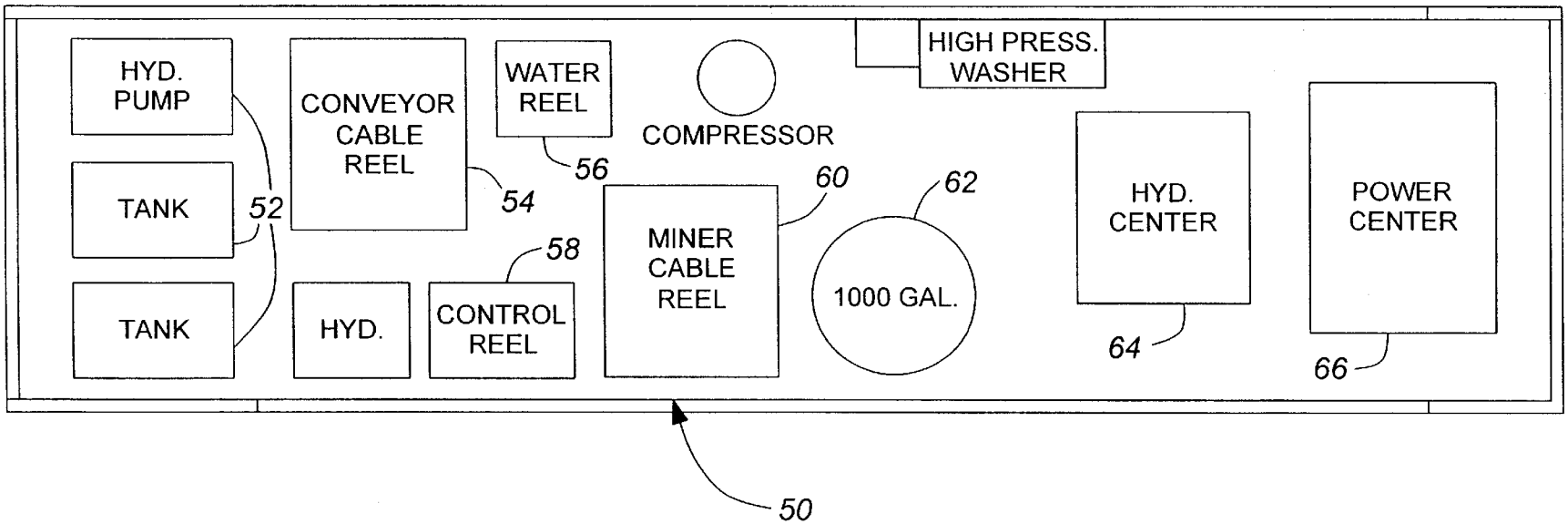
FIG. 2 is a schematic plan view of the equipment layout on the upper deck section of the mining system launch vehicle.

The launch vehicle upper equipment deck 50 will be briefly described (see FIG. 2). This upper equipment deck essentially comprises an elongated enclosure having a roof, side walls, end walls and a floor all designed to safely carry the relatively heavy equipment required to supply the miner 20 and conveyor cars 12 with electrical power and such other supplies as may be required. With reference to FIG. 2, a typical layout of equipment within the upper deck 50 is indicated and it is seen that two smaller tanks 53 and an engine powered hydraulic pump 57 are located adjacent the inner or high-wall end of the deck followed by a relatively large conveyor cable reel 55 which supplies electrical power to the conveyor car drum motors, followed by a smaller water cable reel 56 for supplying the miner 20 and, on the opposite side of the deck a smaller hydraulic control unit to operate the outrigger legs 156, 158 (as described hereafter), followed by a larger control cable reel 58 for supplying control signals to the miner 20, this being followed by a large cable reel 60 for supplying the miner 20 with electrical power. Just rearwardly of the latter is a 1000 gallon storage tank 62 and this is followed by a hydraulic control centre 64 containing the various pumps and hydraulic control valves for operating the various hydraulic cylinders referred to hereinafter. Toward the aft end of the equipment deck is disposed the power centre 66 which contains the various transformers, electrical controls and safety equipment as may be required. A further description of all of these components is not considered necessary here as they are all, in general, individually well-known in the art.

The launch deck 16 as best seen in FIGS. 8–11 includes spaced pairs of elongated built-up beams 70, 72 extending lengthwise with the central space between the spaced pairs of beams 70 being occupied by a launch vehicle conveyor belt 73 (otherwise termed a "belly belt") which extends almost the full length of the launch deck 16 and which is trained about and supported on drive and idler rollers (not shown) in a conventional manner. This conveyor belt 73 is preferably of the same construction as described above in relation to the car conveyor belts.

Figure 16:
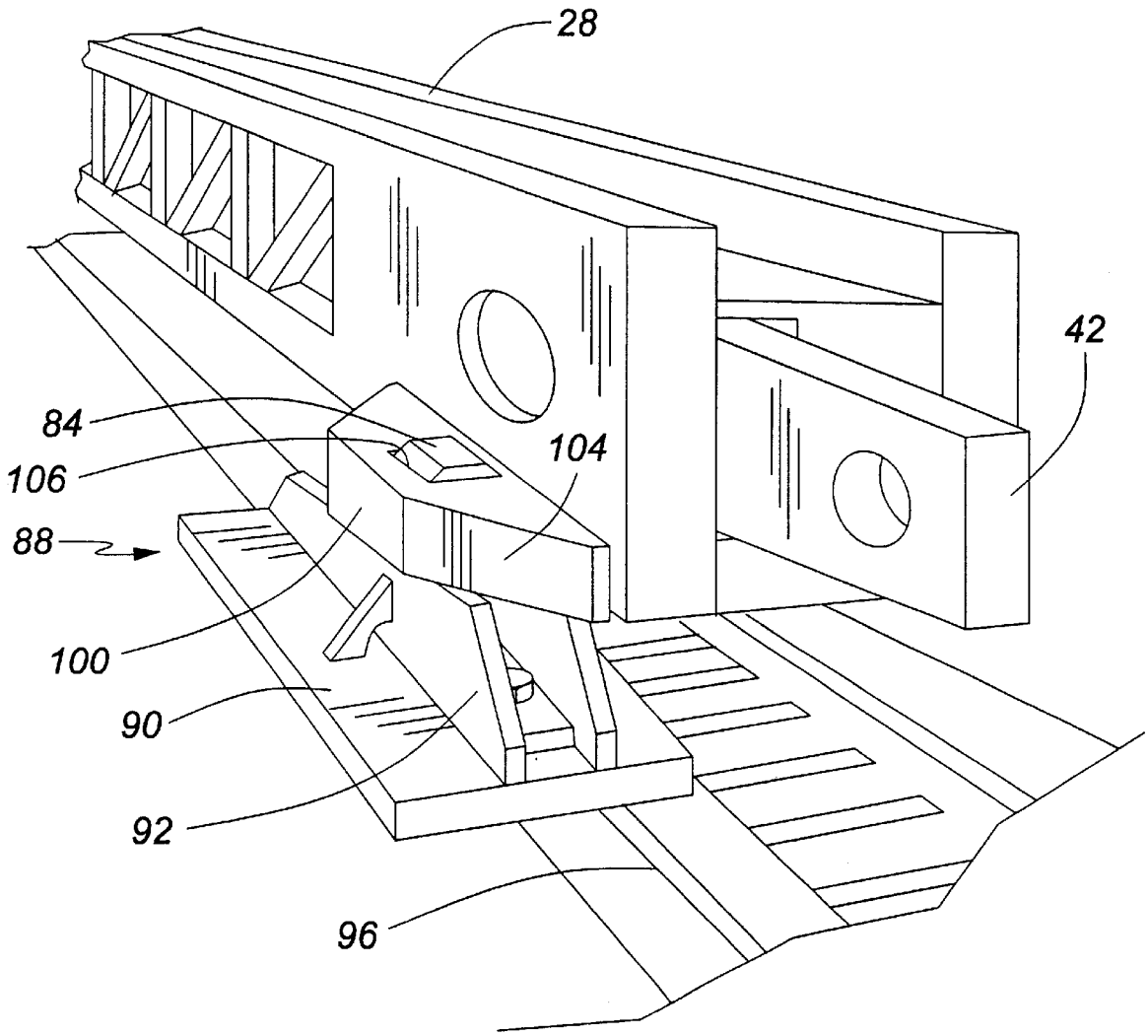
FIGS. 16, 17 and 18 are perspective views of various portions of the hydraulically actuated car engager whereby the conveyor drive cylinders are operatively connected to the individual conveyor cars.
Figure 17:
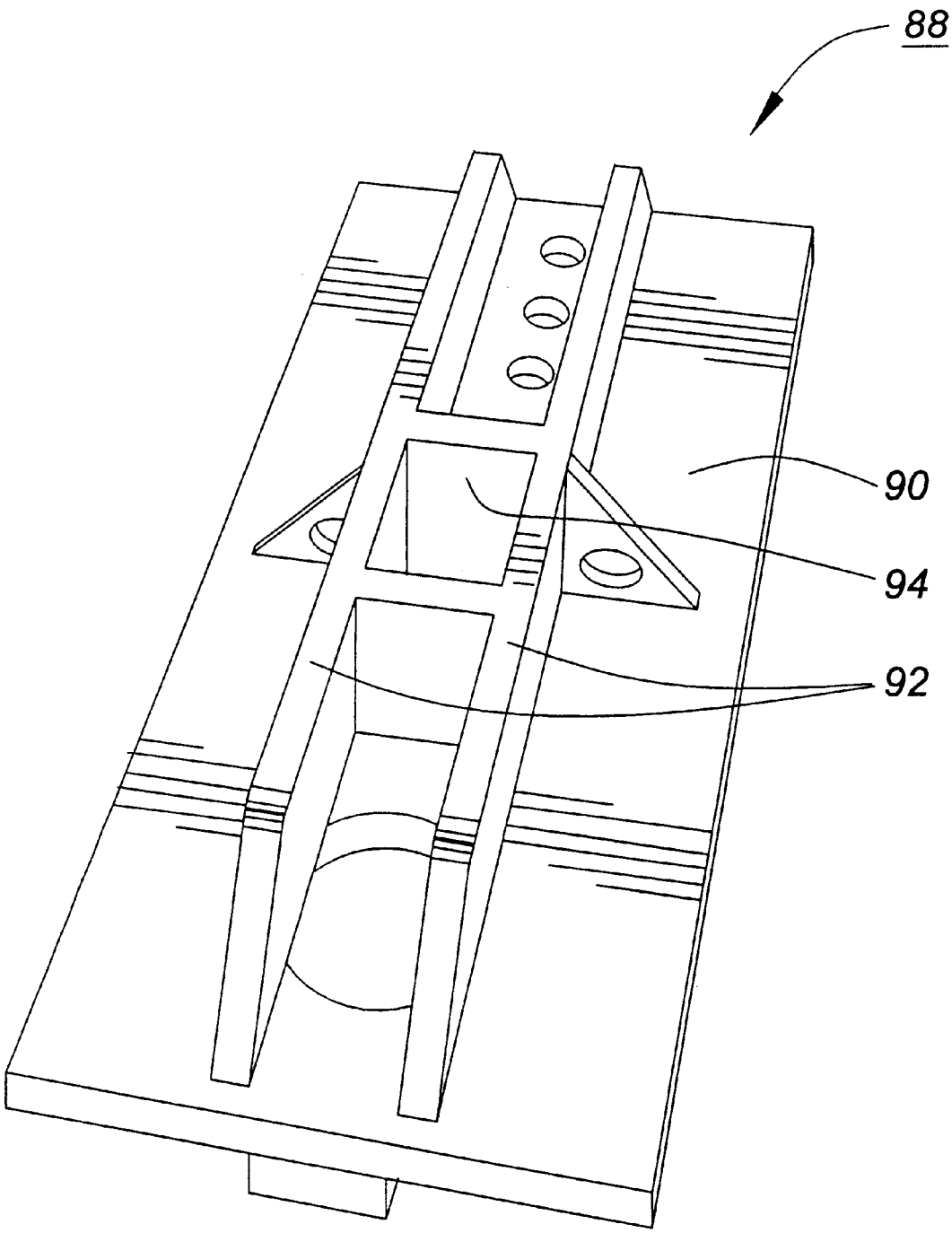
Figure 18:
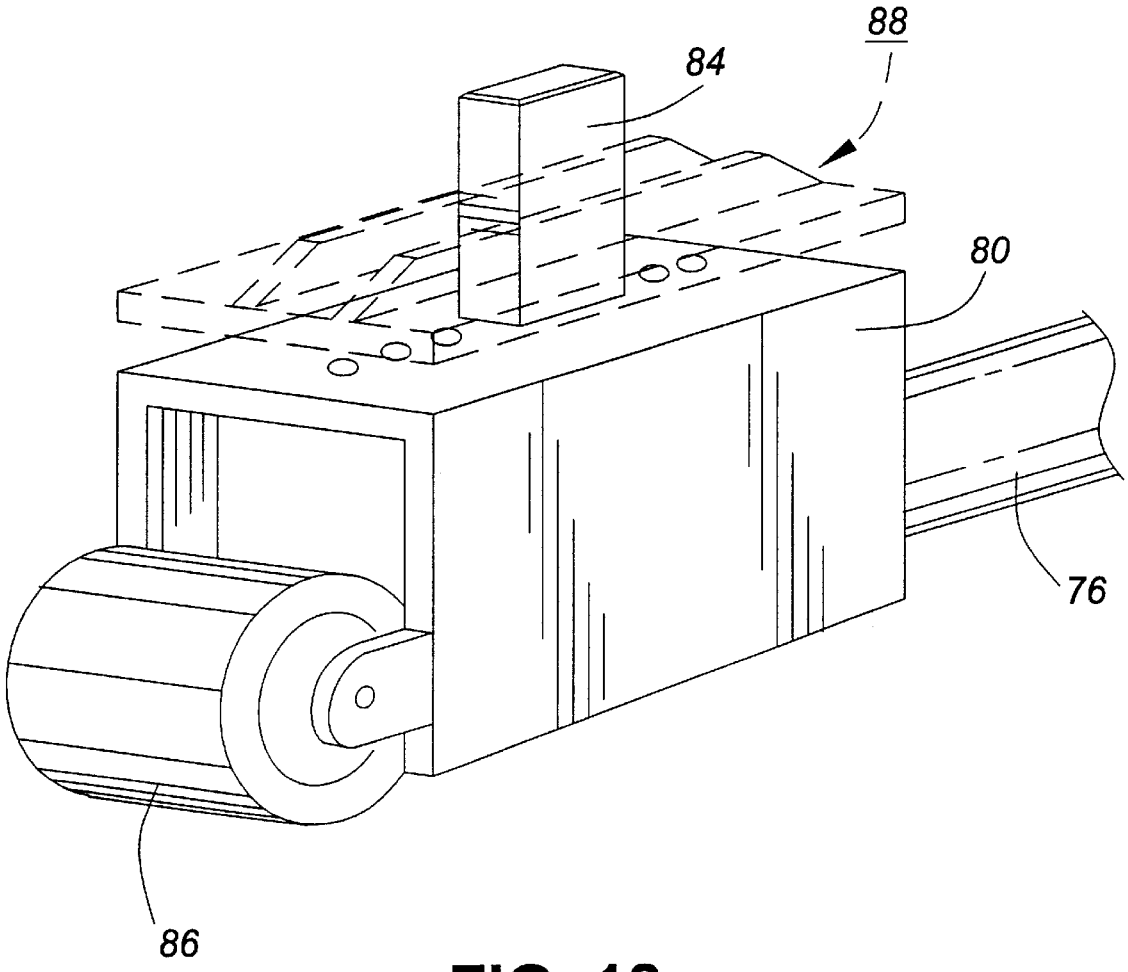
Figure 18A:
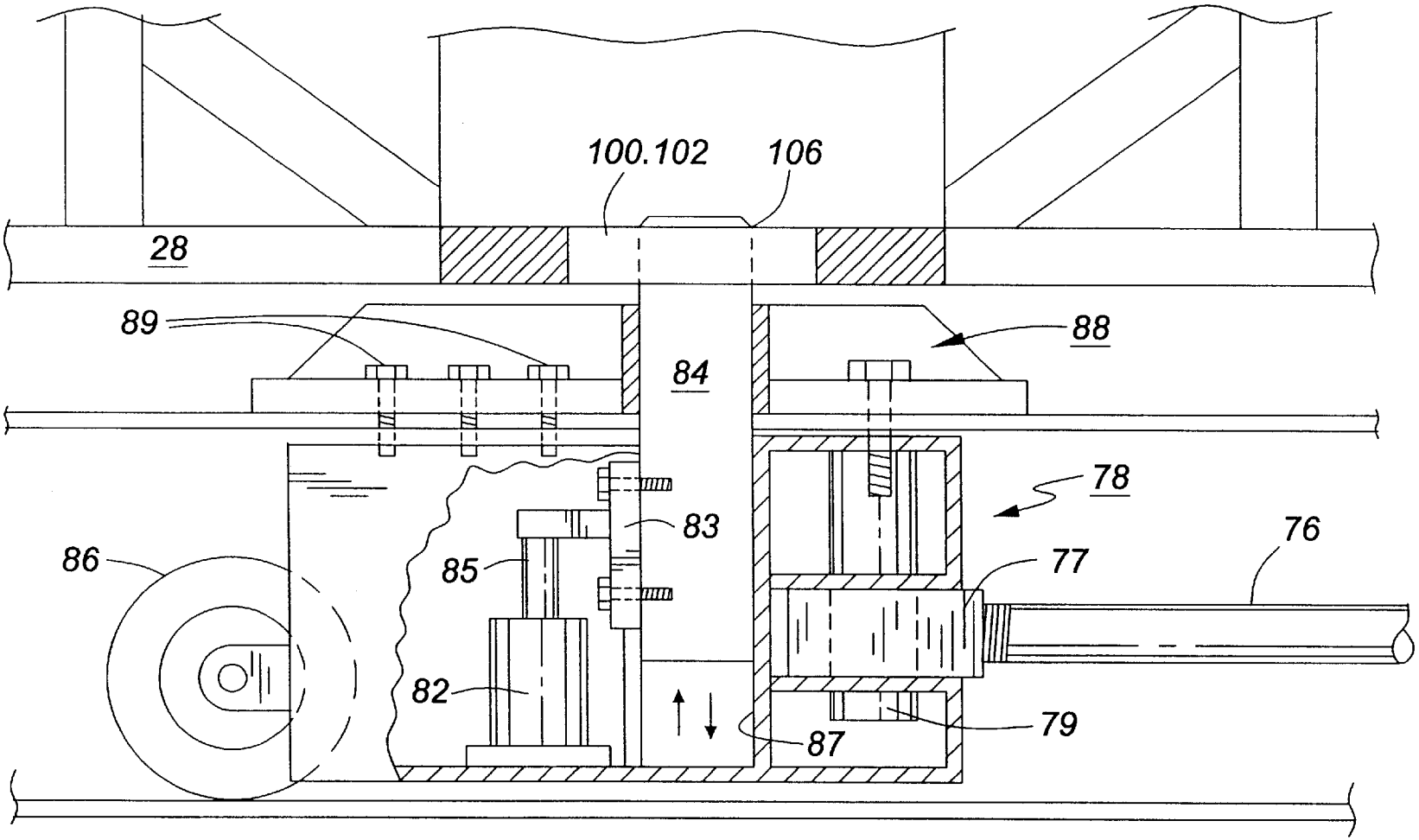
FIG. 18A is a side elevation view, partly in section, of the car engager shown in FIG. 18.

The innermost of the pairs of deck beams 70 have top flange extensions 74 thereon to which serve as track ways to support the outermost conveyor car 12 as it is moved inwardly and outwardly along the deck 16, with the conveyor car wheels 30 rolling along the elongated flange extensions 74. The elongated hydraulic car drive cylinders 24 are located in flanking relation to these inner deck beams 70 and in parallel relation to a conveyor car 12 when supported thereon. Each conveyor car drive cylinder 24 has a ram 76, to the outer end of which is attached (by collar 77 and pin 79) a conveyor car engager 78 (FIGS. 16–18A) capable of transmitting forces from the ram to the conveyor car. Each conveyor car engager 78 includes a sturdy box-like body 80 (FIGS. 18, 18A) fixed to the distal end of the associated ram. Within the box-body there is fixed a short hydraulic engager cylinder 82 having a rectangular male engaging pin 84 fixed to its ram by a bracket 85, which pin 84 moves up and down in a channel 87 defined in body 80. Channel 87 has a slot 89 therein to accommodate the bracket 85. The box bodies 80 are rollingly supported in the channels defined between the innermost deck beams 70 and the outer deck beams 72 by a roller 86 mounted to each box body. A sturdy slide assembly 88 (FIGS. 16 and 17) is fixed above each box body by bolts 89 and includes a flat slide plate 90 having parallel flanges 92 welded thereto together with short transverse plates together defining a vertical rectangular support channel 94 which mates with the pin channel 87 in body 80 and which slidably receives the male engaging pin 84 fixed to the ram of the engaging cylinder 82. Elongated slots 96 (FIGS. 9 and 11) are provided between the flange extensions 74 of the pairs of deck beams which allow the engaging pin 84 within its support channel 94 to travel along the deck 16 with the slide plate 90 of the slide assembly 88 moving over the tops of the deck beams as the conveyor car drive cylinders 24 are activated.

Each of the conveyor cars 12 has two pairs of outwardly projecting engagement lugs 100, 102 on opposing sides thereof (FIGS. 8, 11 and 16), one pair 100 at the aft end and the other pair 102 at the conveyor car mid-length point. Each lug has fore and aft sloping faces 104 and a central rectangular socket 106 adapted to receive the male engaging pin 84 of the conveyor car engager. Thus, when the conveyor car drive cylinders 24 are positioned to bring the engaging pins 84 into alignment with the lug sockets 106, the hydraulic engaging cylinders 82 in the conveyor car engagers 78 may be activated to extend the pins 84 into the lug sockets 106 to effect a positive drive connection between them. The several conveyor car drive components noted above must be strongly built as a typical embodiment will employ conveyor car drive cylinders 24 capable together of exerting up to 500,000 lbs. of thrust each.

The launch deck 16 is further equipped with a pair of laterally spaced stabilizing cylinders 110 (FIGS. 9 and 10) located outboard of the conveyor car drive cylinders 24 and adjacent the fore or highwall end of the deck 16 in alignment therewith. The rams of these cylinders 110 are capable of being extended forwardly of the launch deck and into engagement with parts of the highwall formation being mined to assist in securing and stabilizing the launch vehicle 14 during operation.

The highwall end of the launch deck is also provided with a pair of blast doors 114 (FIGS. 8, 13 and 15) which are closed to form a shallow V-shaped formation (as seen in plan) during a mining operation, so as to deflect material laterally which may be ejected from the mine shaft in the event of an explosion. These doors are suspended from overhead tracks 116 via rollers 118 so that the doors may be shifted between open and closed positions by hydraulic cylinders 120 mounted parallel to the trackways 116.

The rear or aft end of the launch deck is also provided with a staging cylinder 122 (FIGS. 8, 9 and 11), the ram of which can be extended outwardly into engagement with a conveyor car which is being added to or removed from the end of the conveyor train. The staging cylinder ram has a hook 124 or the like on its end shaped to engage in a lug socket 106 adjacent to the end of the conveyor car 12 so as to move it to or fro a small distance sufficient as to allow the conveyor car drive cylinders to be effectively connected to the conveyor car via the mechanisms described previously. The staging cylinder 122 can be pivoted slightly in a vertical plane to allow the hook 124 to be engaged and disengaged as required.

Another feature of the launch deck is the provision, at the fore or highwall end, of a pair of stop cylinders 126 (FIG. 9) mounted to and above the deck and capable of being advanced into engagement with a next-to-last conveyor car of the conveyor train to prevent unwanted motion of the train back into a sloping seam at those intervals of time when the car engaging devices are not in fact engaged with a conveyor car. These stop cylinders 126 are located on opposing sides of the car 12 and are angled inwardly and rearwardly as shown such that when their rams 128 are extended they come into abutting contact with the forwardly sloping faces 104 of the above-described engagement lugs 100, 102 on the opposing sides of the conveyor car. The stop cylinders 126 are of particular use to securely hold the conveyor train in position when steep dip mining is being undertaken. When the conveyor train is again to be advanced or retracted, the stop cylinder rams 128 are retracted clear of the outwardly projecting engagement lugs 100, 102.

The previously noted pair of telescoping extendible support columns 54 is secured to an aft end portion of the launch vehicle 14 in flanking relation thereto. The columns 54 as noted previously have elongated hydraulic cylinders 130 disposed therein to effect controlled lifting and lowering of the aft end of the launch vehicle 14 and to tilt the latter in a vertical plane as desired to accommodate the dip angle of the seam to be mined. The dip angle as noted above may be as much as 30°. The previously noted further pair of telescoping extendible support columns 52 is secured to a forward end portion of said launch vehicle 14 in flanking relation thereto. Similarly, hydraulic cylinders (not shown) are contained within these columns for effecting controlled lifting and lowering of the forward end of the launch vehicle 14 to effect substantial alignment of the launch deck 16 with an exposed face of the seam.

The above-noted support columns 54 at the aft end of the launch vehicle are pinned via suitable pivot means 134 to opposing sides of said launch deck 16 aft end portion to allow pivotal motion of said support columns 54 relative to said deck during lifting and lowering operations. The launch vehicle has U-shaped bracket stops 136 (FIGS. 1 and 3) fixed to the upper deck to limit the motion of the aft end support columns. Both sets of fore and aft support columns 52, 54 can be removed or attached to the launch vehicle via bolt fasteners 138, 140 for purposes to be described hereafter.

Figure 19:
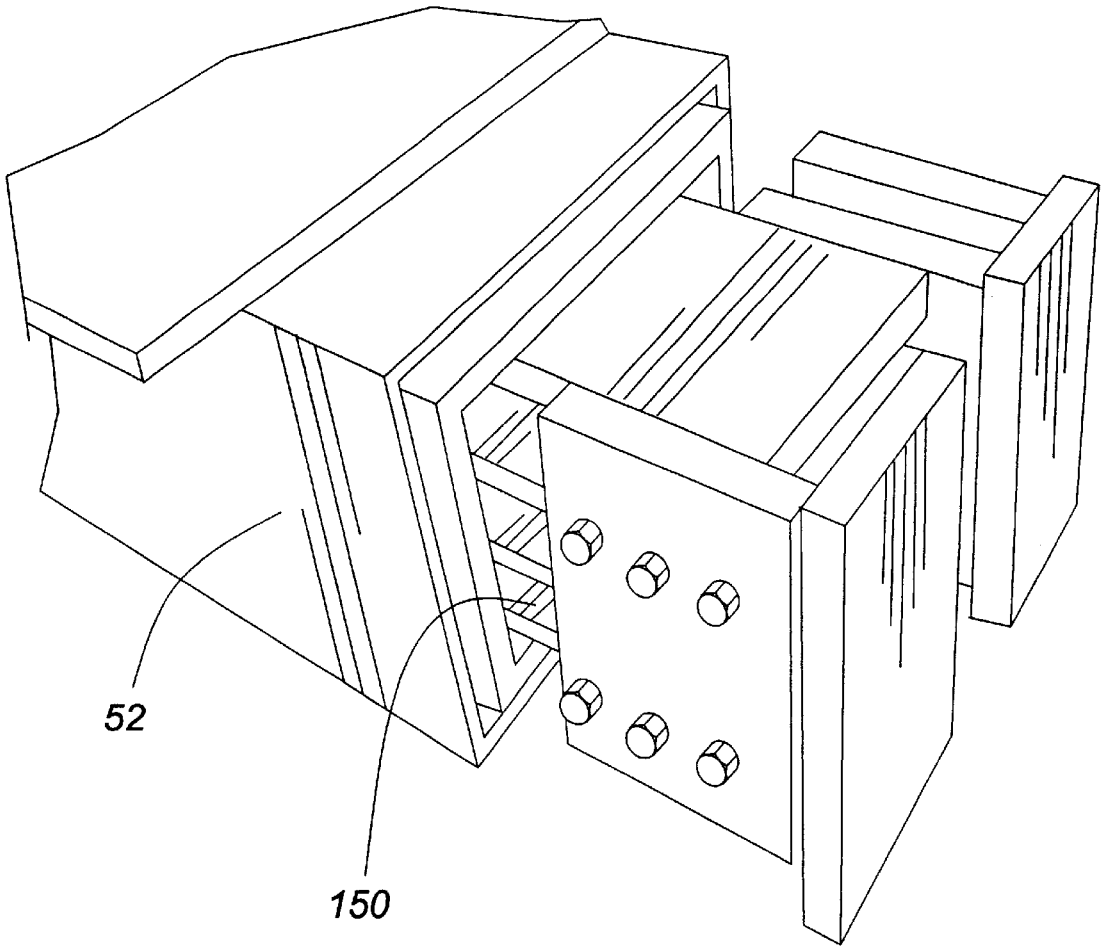
FIGS. 19 and 20 are perspective views of the articulated feet at the bottom of the extendible support columns.
Figure 20:
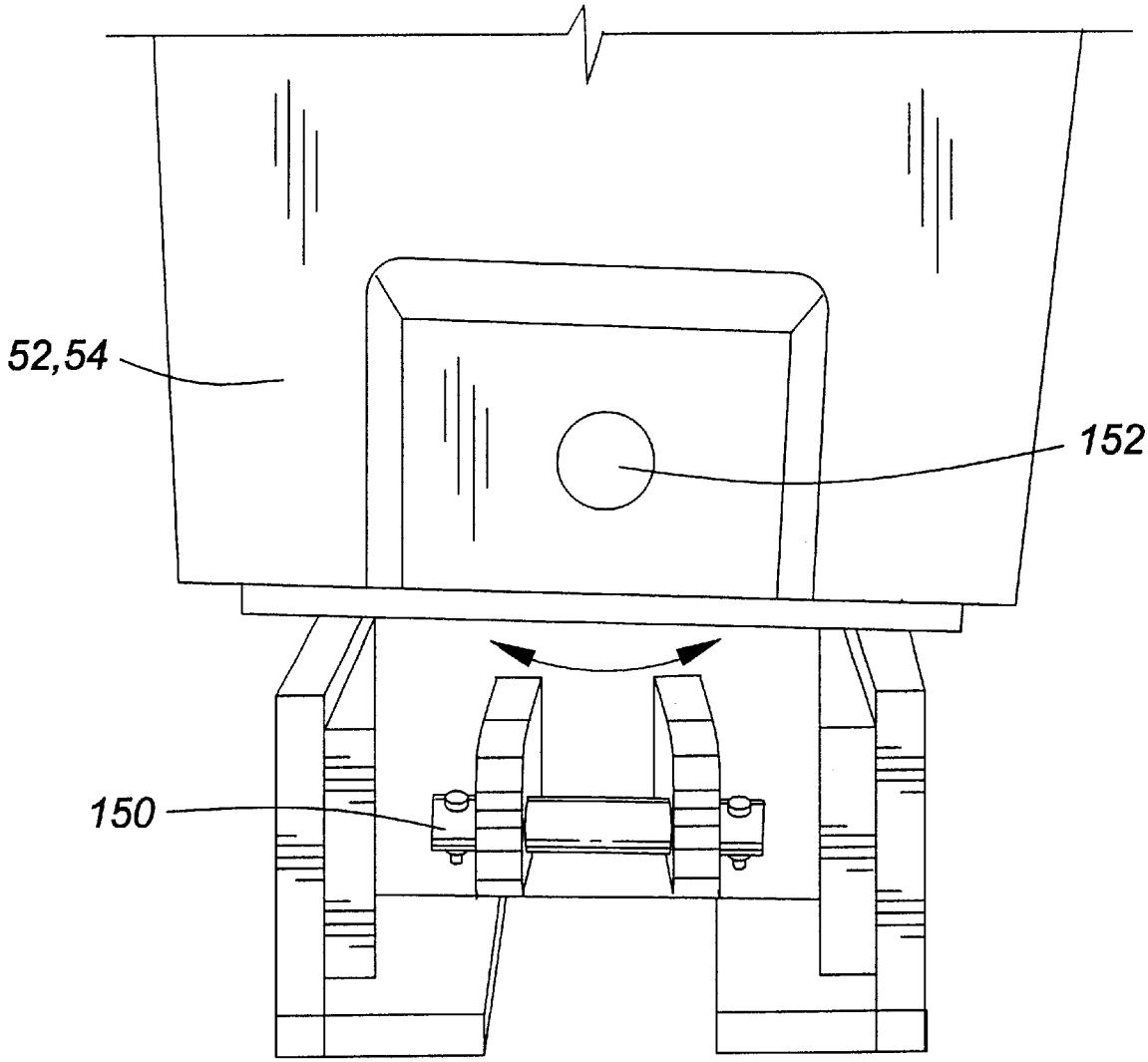

The launch vehicle 14 further includes skid tracks 142, 144 (FIGS. 8 and 10) located below the lower ends of both the forwardly and the rearwardly located pairs of support columns 52, 54. Each skid track is adapted to be supported on the earth when in use and these tracks extend laterally of the launch deck 16. Elongated skid cylinders 146, 148 are connected between an outer end of each skid track and an associated lower end of each pair of support columns. By activating the skid cylinders 146, 148 either or both of the fore and aft ends of the launch vehicle 14 can be shifted laterally and the launch vehicle angularly adjusted as desired in a horizontal plane. The lowermost ends of each of said support columns 52, 54 each have a skid foot 150 (FIGS. 8, 19 and 20) mounted thereto via a pivot pin 152 (FIG. 20) passing through the lower end of the inner telescoping section of each column and extending parallel to the associated skid track. Forces on said launch vehicle tending to displace the latter rearwardly (as when the conveyor train is being pushed into the shaft) cause said feet 150 and said tracks 142, 144 on which the skid feet slide to tilt slightly about the axes provided by the pivot pins 152 and to dig in to the earth to resist displacement of the launch vehicle 14 under the influence of these forces.

Figure 12:
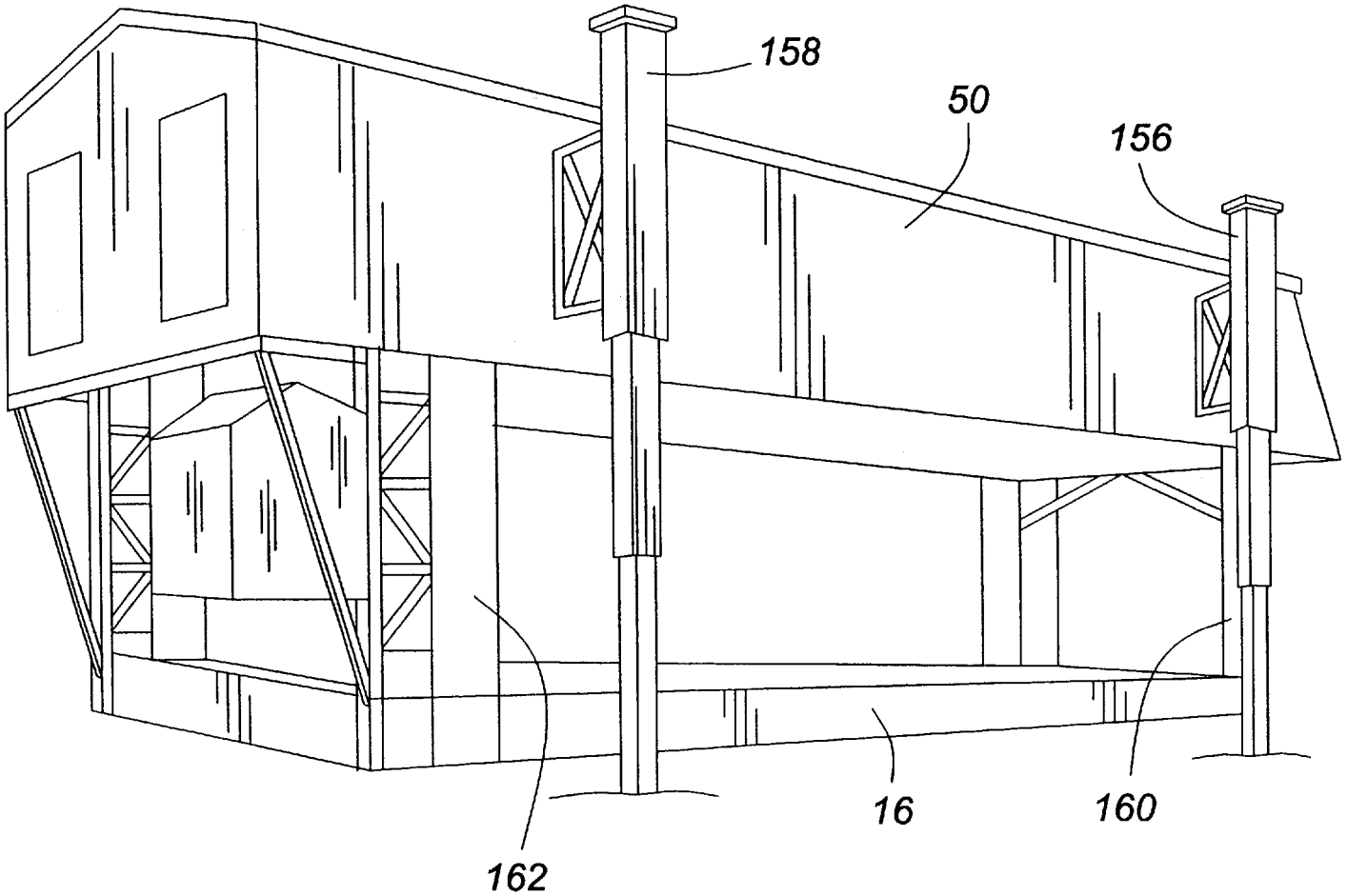
FIG. 12 is a perspective view showing outriggers connected to and supporting the upper deck in preparation for transport.

Another notable feature of the highwall mining system is that it can readily be partly dismantled and transported to another location. With the structure as disclosed, the system can be dismantled by a small crew fairly quickly (e.g. a day or so), conveniently transported, and then reassembled. This contrasts with the significant delay of many days required for relocation of known mining systems. Thus, with particular reference to FIGS. 12 to 14 it will be seen that fore and aft pairs of outrigger legs 156, 158 are attached to fore and aft end portions of the upper deck 50 for temporarily supporting the latter above the launch deck 16 such as to allow the launch deck 16 to be removed from beneath said upper deck 50 for transport purposes. Spaced fore and aft uprights 160, 162 are connected between the upper deck 50 and the launch deck (FIG. 12) and secure the upper deck and launch decks in spaced parallel relation during normal use. Uprights 160, 162 are permanently attached to the launch deck and are disconnected from the upper deck when the outriggers are in use to allow the launch deck to be removed by towing it outwardly (with the blast doors shut) and allowing the upper deck to be lowered downwardly as described below.

The outrigger legs 156, 158, being in the form of telescoping sections having elongated hydraulic cylinders therein, are extendible and retractable such that on retraction the upper deck 50 may be lowered downwardly onto a suitable transport device, such as a flat bed truck. Following transport to a desired location, the outrigger legs 156, 158 are again extended to raise the upper deck thus allowing said launch deck 16 to be again located therebeneath with the uprights 160, 162 again serving to secure the upper and launch decks in the desired spaced parallel relation. The outrigger legs are removed during normal mining operations. As noted previously the support columns 52, 54 are readily detachable from the launch vehicle to permit ready transport of said decks and they are easily reattached during the reassembly process.

Figure 13:
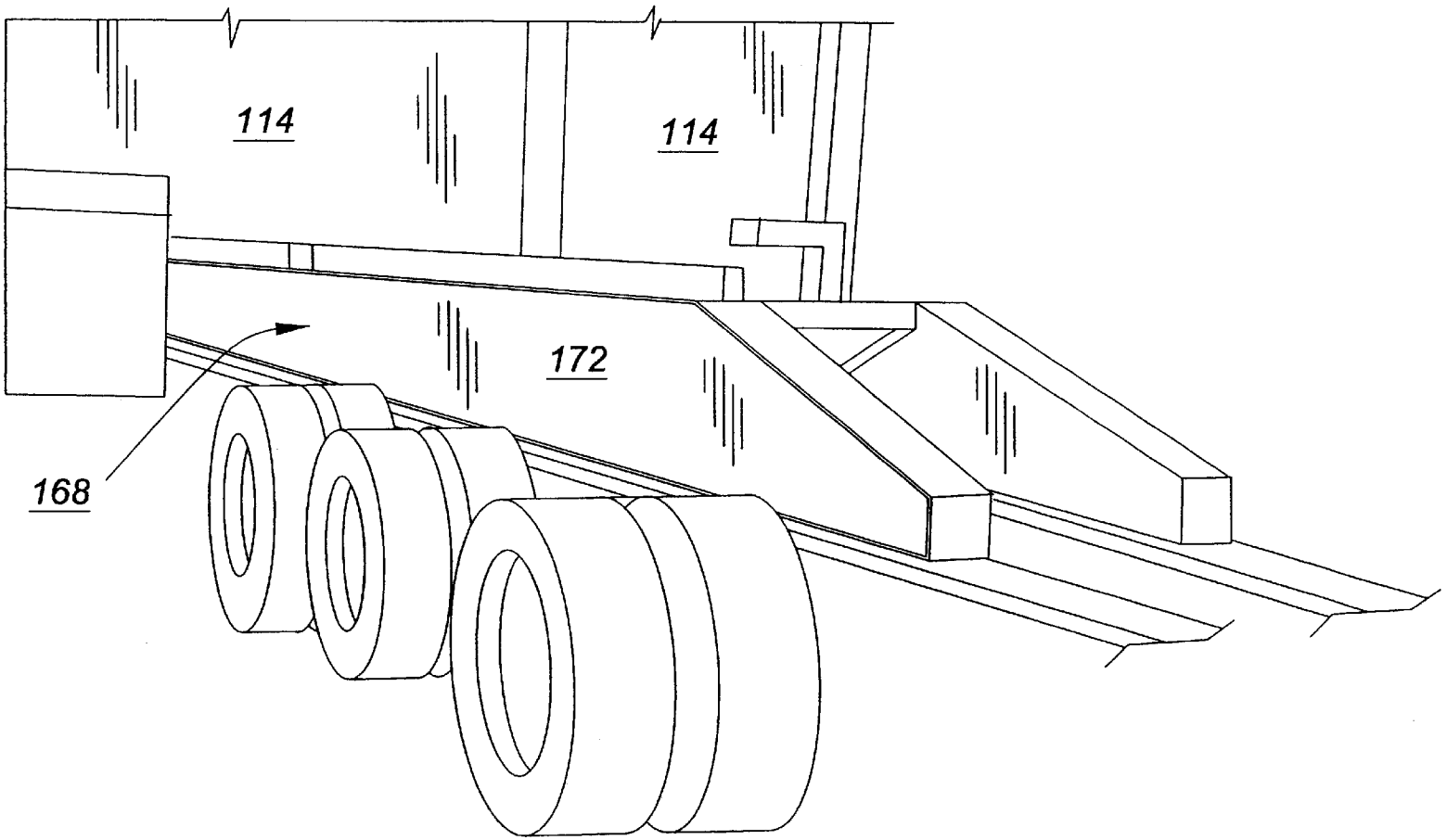
FIG. 13 is a perspective view showing a wheel and axle assembly connected to one end of the launch deck in preparation for transport.
Figure 14:
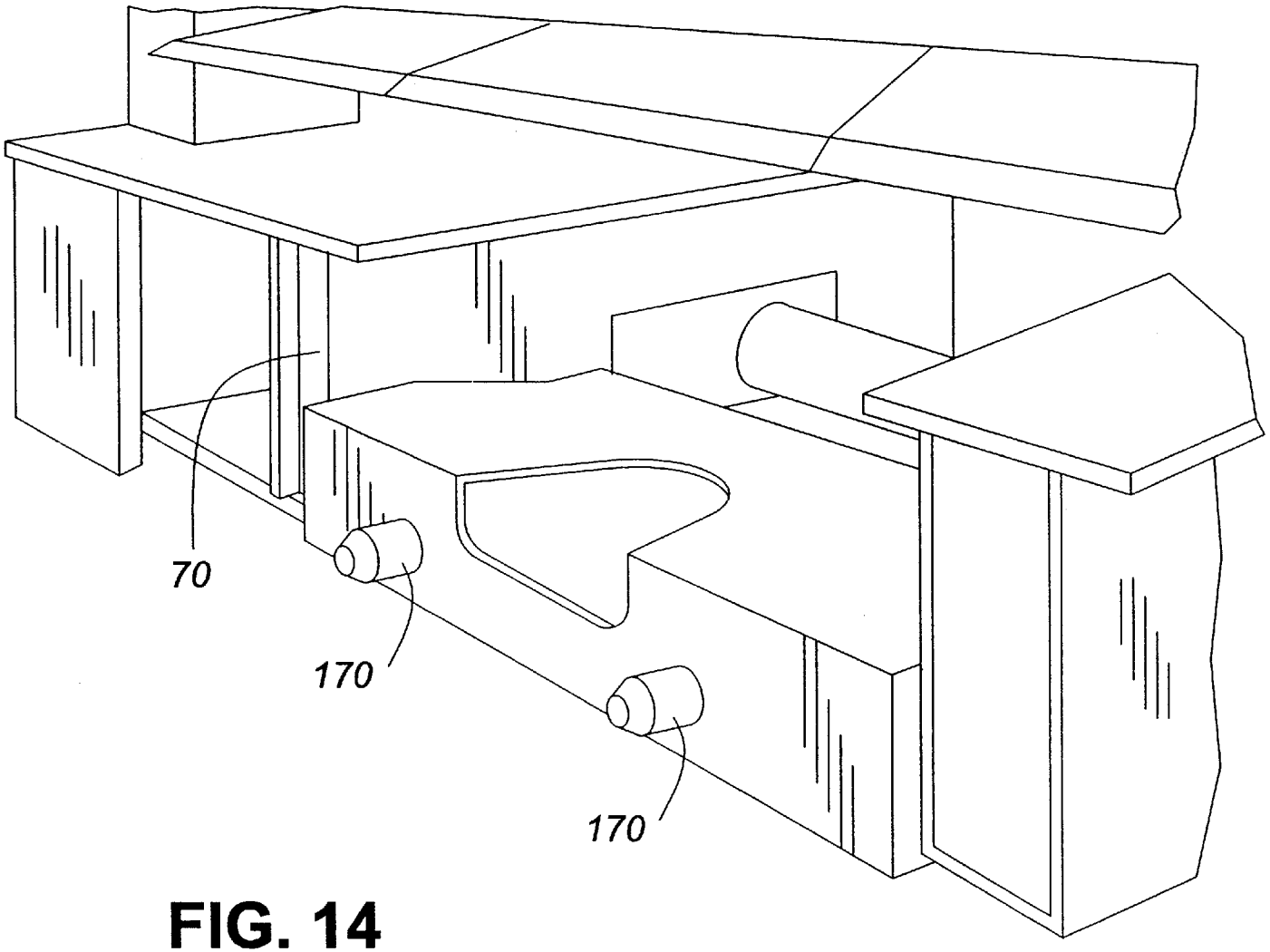
FIG. 14 shows a perspective view of the wheel and axle assembly attachment provided in an end of the launch deck of the launch vehicle.
Figure 15:
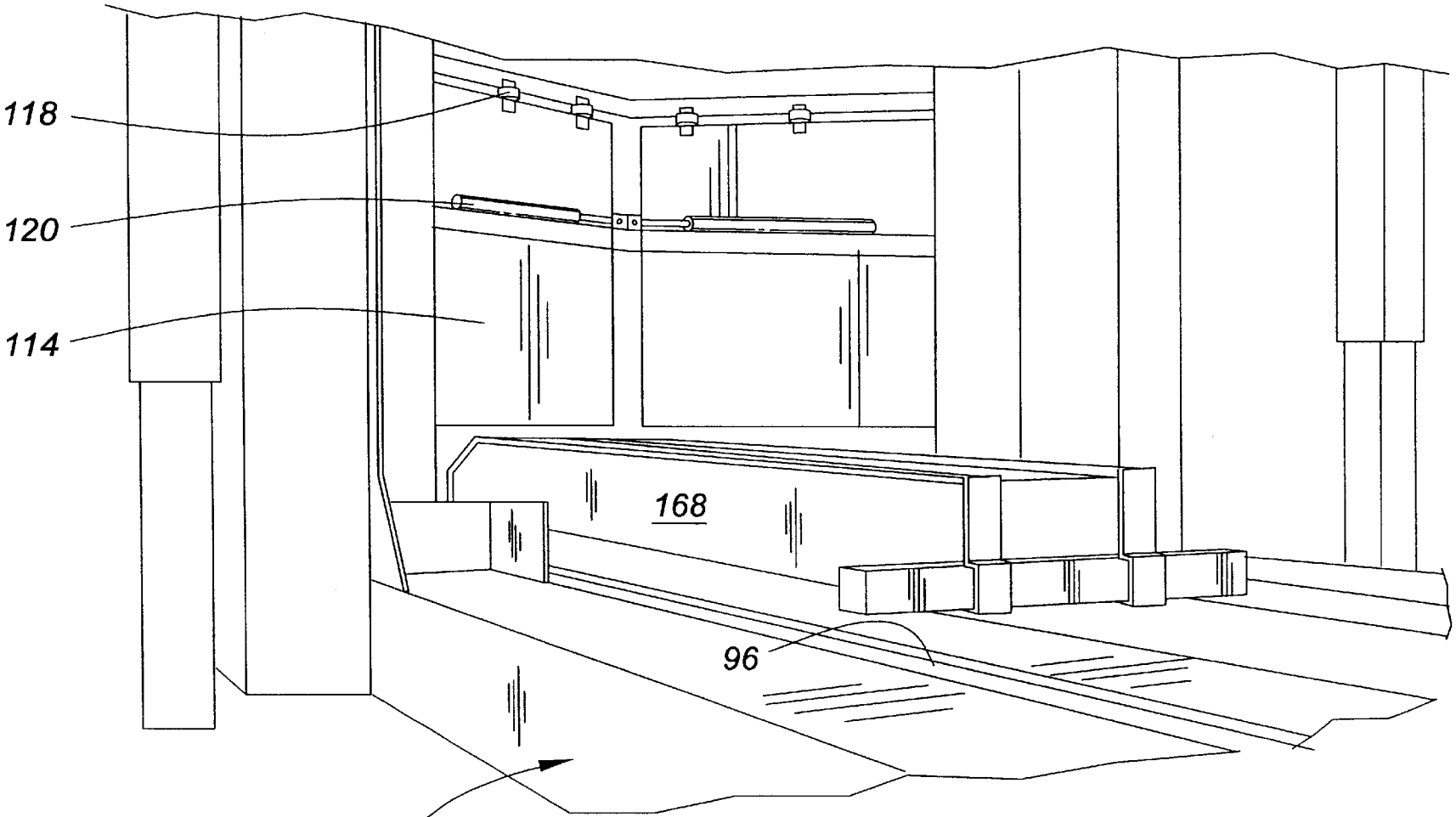
FIG. 15 is a perspective view looking generally toward the front or highwall end from the rear and showing the wheel and axle attachment affixed for transport purposes together with a view of the blast doors in a partly closed condition.

Referring to FIGS. 13 to 15, it will be seen that the launch deck 16 is provided with detachable wheel and axle sets 168 at its opposing ends to permit the launch deck 16 to be towed away from beneath the upper deck 50 by a transport truck. Interengaging pin 170 (FIG. 14) and socket arrangements plus elongated frame arm configurations 172 known per se provide a good combination of stability and ease of use.

The method of operation of the mining system will be fairly evident from the above description. The launch vehicle 14 is moved to the site as described above and positioned on the bench B. The fore and aft support columns 52, 54 are extended as required to align the deck 16 with the seam S to be mined. The various electrical power and control cables are connected to the miner 20 and the lead conveyor car and, under remote control of the operator with the aid of video monitors on the miner, the mining operation commences.

The hydraulic conveyor car drive cylinders 24 are engaged with the lead conveyor car by bringing the pin members 84 into alignment with the sockets of engagement lugs 100, 102 on the conveyor car 12 and activating the engager cylinders 82 to extend the drive pins 84 into the sockets 106 following which the miner 20 and lead conveyor car are advanced forwardly by drive cylinders 24 to commence mining. The conveyor car and launch deck conveyors 22, 72 are powered up and running also, along with the stacker conveyor 18 at the rear of the launch deck to convey the mined coal. Once the miner 20 has advanced far enough that a further conveyor car 12 can be added, a front end loader gently places a further conveyor car 12 on the launch deck 16. The staging cylinder moves the conveyor car 12 forward until the conveyor car drive cylinder 24, released from the preceding conveyor car 12, can now reach and engage with the newly added conveyor car 12. The car drive cylinder moves the newly added conveyor car 12 into engagement with the preceding conveyor car and the coupling pins 46 are inserted by the operating personnel to connect the conveyor cars together. The newly added conveyor car is electrically connected to the preceding conveyor car by a cable and connector (not shown) and the power turned on to start its conveyor running. The conveyor car drive cylinders are then carefully advanced to bring the miner 20 against the coal face, with the mined coal being carried out by the car and launch vehicle conveyors on to the stacker conveyor 18 and thence outwardly of the mining system for transport to another location. This general procedure is repeated as needed until the maximum depth has been reached (in the absence of other miscellaneous problems that can be encountered). Following this the conveyor train is retracted from the seam S one conveyor car at a time using the reverse procedure i.e. sequentially by pulling each conveyor car back with the drive cylinders 24, advancing the stop cylinders 126 to secure the conveyor train, disconnecting the drive cylinders, removing the coupling pins 46 and using the staging cylinder 122 to pull the last car away a short distance from the coupler of the preceding car, effecting electrical disconnection and then using the front end loader to lift the conveyor car 12 away from the launch deck 16 to a storage area. This action is repeated until the miner 20 has been withdrawn from the shaft at which point the entire launch vehicle 14 can be shifted laterally on the skid tracks 142, 144 by actuating the skid cylinders 146, 148 together or separately to skid and walk the launch vehicle 14 laterally the desired distance needed to commence a new shaft. The procedure described above is then repeated.

The brief description of operation given above only covers the most basic operational features of the mining apparatus. The basic safety, control and other operational details will be readily apparent to those skilled in the mining arts and need not be further discussed here.

A preferred embodiment of the invention has been described by way of example. Those skilled in the art will realize that various modifications and changes may be made while remaining within the spirit and scope of the invention. Hence the invention is not to be limited to the embodiment as described but, rather, the invention encompasses the full range of equivalencies as defined by the appended claims.

What is claimed is:

1. A highwall mining system particularly suitable for steep dip seams and of the type wherein multiple conveyor cars are connected together to form a conveyor train which extends into a seam being mined, comprising:

(a) an elongated launch vehicle having a launch deck for receiving and supporting a conveyor car which is to be added to or removed from an outer end of the conveyor train when in operation, said launch deck having a conveyor belt running lengthwise thereof and and extending to an aft end of said launch vehicle;

(b) a plurality of conveyor cars forming the conveyor train and adapted to convey mined material outwardly to the conveyor belt of said launch deck;

(c) a miner attached to an inner end of said conveyor train for cutting material from the seam being mined and moving it to the inner end of the conveyor train for conveyance by the latter outwardly to said launch deck;

(d) a pair of extendible support columns secured to an aft end portion of said launch deck in flanking relation thereto and having hydraulic cylinders associated therewith to effect controlled lifting and lowering of said aft end of the launch deck and to tilt the latter in a vertical plane as desired to accommodate the dip angle of the seam to be minded; and (e) a pair of elongated hydraulic conveyor car drive cylinders mounted to said launch deck and remaining in parallel relation thereto and to the last of said conveyor cars when supported on said launch deck throughout all tilt angles of said launch deck, said conveyor car drive cylinders each including a ram having activatible conveyor car engaging devices thereon such that actuation of said drive cylinders in conjunction with said engaging devices causes said conveyor cars to be advanced into a seam being mined or to be retracted therefrom as desired.

2. The highwall mining system of claim 1 wherein a further pair of extendible support columns is secured to a forward end portion of said launch deck in flanking relation thereto and having hydraulic cylinders associated therewith for effecting controlled lifting and lowering of the forward end portion to effect substantial alignment of the launch deck with an exposed face of the seam.

3. The highwall mining system of claim 2 wherein said support columns at the aft end of the launch deck are pinned to opposing sides of said launch deck aft end portion to allow pivotal motion of said support columns relative to said deck, said launch vehicle having stops to limit the degree of said pivotal motion of the aft end support columns.

4. The highwall mining system of claim 2 wherein the launch deck is further equipped with a pair of laterally spaced stabilizing cylinders each located at the forward end of the deck in alignment therewith and capable of being extended forwardly of said deck and into engagement with parts of the highwall formation being mined to assist in securing and stabilizing the launch vehicle during operation.

5. The highwall mining system of claim 1 wherein said launch deck further includes a staging cylinder having a ram movable into and out of engagement with the last conveyor car of said train to assist in effecting any desired motion of same lengthwise of said deck in the course of loading and unloading of the conveyor cars to and from said deck to facilitate connecting said last conveyor car to the next adjacent car or disconnecting same.

6. The highwall mining system of claim 1 further including stop cylinders mounted to said launch deck and capable of being advanced into engagement with a next-to-last conveyor car of the conveyor train to prevent unwanted motion of the train back into a sloping seam at those intervals of time when said conveyor car engaging devices are not engaged with said next-to-last car.

7. A highwall mining system particularly suitable for steep dip seams and of the type wherein multiple conveyor cars are connected together to form a conveyor train which extends into a seam being mined, comprising:

(a) an elongated launch vehicle having a launch deck for receiving and supporting a conveyor car which is to be added to or removed from an outer end of the conveyor train when in operation, said launch deck having a conveyor belt running lengthwise thereof and extending to an aft end of said launch vehicle;

(b) a plurality of conveyor cars forming the conveyor train and adapted to convey mined material outwardly to the conveyor belt of said launch deck;

(c) a miner attached to an inner end of said conveyor train for cuffing material from the seam being mined and moving it to the inner end of the conveyor train for conveyance by the latter outwardly to said launch deck;

(d) a pair of extendible support columns secured to an aft end portion of said launch deck in flanking relation thereto and having hydraulic cylinders associated therewith to effect controlled lifting and lowering of said aft end of the launch deck and to tilt the latter in a vertical plane as desired to accommodate the dip angle of the seam to be mined;

(e) a further pair of extendible support columns secured to a forward end portion of said launch deck in flanking relation thereto and having hydraulic cylinders associated therewith for effecting controlled lifting and lowering of the forward end portion to effect substantial alignment of the launch deck with an exposed face of the seam; and (f) skid tracks located below the lower ends of both the forwardly and the rearwardly located pairs of support columns, each skid track extending laterally of the launch deck and adapted to be supported on the earth when in use, and an elongated skid cylinder connected between each skid track and an associated lower end of each pair of support columns such that either or both of the fore and aft ends of the launch vehicle can be shifted laterally and the launch vehicle angularly adjusted as desired in a horizontal plane.

8. The highwall mining system of claim 7 wherein the lowermost ends of said support columns each have a foot mounted thereto via a pivot pin extending parallel to the associated skid track to permit limited pivotal motion of each said foot relative to its associated support column during operation.

9. A highwall mining system particularly suitable for steep dip seams and of the type wherein multiple conveyor cars are connected together to form a conveyor train which extends into a seam being mined comprising:

(a) an elongated launch vehicle having a launch deck for receiving and supporting a conveyor car which is to be added to or removed from an outer end of the conveyor train when in operation;

(b) said launch deck having a conveyor belt running lengthwise thereof to receive mined material which has been transported along the conveyor train and to convey and discharge said material from the rear or aft end of the launch vehicle;

(c) a miner for cutting material from the seam being mined and moving it to an inner end of the conveyor train;

(d) a plurality of conveyor cars connected end to end to define said conveyor train and extending, when in use, from said miner at an inner or front end of the train rearwardly to a last conveyor car on said launch deck, each conveyor car having a powered conveyor belt with said belts of the cars in the conveyor train being in closely adjacent relation to each other to provide continuity of conveyance of the mined material for discharge thereof onto the conveyor belt of the launch deck;

(e) a pair of elongated hydraulic conveyor car drive cylinders mounted to said launch deck in substantially parallel relation to a last said conveyor car when supported on said launch deck, said conveyor car drive cylinders each including a ram having actuator driven conveyor car engaging devices thereon for positively engaging with and disengaging from each conveyor car in turn such that actuation of said drive cylinders in conjunction with said conveyor car engaging devices causes the entire conveyor train defined by said conveyor cars together with said miner to be advanced into a seam being mined or to be retracted therefrom as desired.

10. The highwall mining system of claim 9 wherein each of said conveyor cars has engagement lugs on opposing sides thereof, each said lug having a socket therein, said actuator driven conveyor car engaging devices on the rams of said drive cylinders including male pin members adapted to enter said sockets of the engagement lugs of the last conveyor car on said launch deck to enable transmittal of forces from said drive cylinders via said engagement lugs to said conveyor car and thence to the entire conveyor train; and an actuator associated with each of said male pin members to effect their advancement into said sockets of the lugs and withdrawal therefrom whereby as said drive cylinders are advanced and retracted said conveyor train is advanced or retracted as desired.

11. The highwall mining system of claim 9 wherein said launch deck further includes a staging cylinder having a ram movable into and out of engagement with the last conveyor car of said train to assist in effecting any desired motion of same lengthwise of said deck in the course of loading and unloading of the conveyor cars to and from said deck to facilitate connecting said last conveyor car to the next adjacent car or disconnecting same.

12. The highwall mining system of claim 9 further including stop cylinders mounted to said launch deck and capable of being advanced into engagement with a next-to-last conveyor car of the conveyor train to prevent unwanted motion of the train back into a sloping seam at those intervals of time when said conveyor car engaging devices are not engaged with said next-to-last car.

13. The highwall mining system of claim 9 including a pair of extendible support columns secured to an aft end portion of said launch deck in flanking relation thereto and having hydraulic cylinders associated therewith to effect controlled lifting and lowering of said aft end of the launch deck and to tilt the latter in a vertical plane as desired to accommodate the dip angle of the seam to be mined.

14. The highwall mining system of claim 13 wherein a further pair of extendible support columns is secured to a forward end portion of said launch deck in flanking relation thereto and having hydraulic cylinders associated therewith for effecting controlled lifting and lowering of the forward end portion to effect substantial alignment of the launch deck with an exposed face of the seam.

15. The highwall mining system of claim 14 wherein said support columns at the aft end of the launch deck are pinned to opposing sides of said launch deck aft end portion to allow pivotal motion of said support columns relative to said deck, said launch vehicle having stops to limit the degree of said pivotal motion of the aft end support columns.

16. The highwall mining system of claim 14 wherein the launch deck is further equipped with a pair of laterally spaced stabilizing cylinders each located at the forward end of the deck in alignment therewith and capable of being extended forwardly of said deck and into engagement with parts of the highwall formation being mined to assist in securing and stabilizing the launch vehicle during operation.

17. The highwall mining system of claim 14 further including skid tracks located below the lower ends of both the forwardly and the rearwardly located pairs of support columns, each skid track extending laterally of the launch deck and adapted to be supported on the earth when in use, and an elongated skid cylinder connected between each skid track and an associated lower end of each pair of support columns such that either or both of the fore and aft ends of the launch vehicle can be shifted laterally and the launch vehicle angularly adjusted as desired in a horizontal plane.

18. The highwall mining system of claim 17 wherein the lowermost ends of said support columns each have a foot mounted thereto via a pivot pin extending parallel to the associated skid track to permit limited pivotal motion of each said foot relative to its associated support column during operation.

19. A transportable launch vehicle for a highwall miner having multiple elongated conveyor cars that may be connected together to form a conveyor train, said launch vehicle comprising:

(a) an elongated launch deck for receiving and supporting a conveyor car which is to be added or removed from an end of the conveyor train when in operation;

(b) an upper equipment deck disposed, in use, in connected and spaced relation above said launch deck;

(c) fore and aft pairs of extendible support columns secured to said launch deck in flanking relation thereto and having hydraulic cylinders associated therewith for tilting and changing the elevation of the entire launch vehicle as required to accommodate the dip angle and location of the face of a seam to be mined;

(d) fore and aft pairs of outrigger legs attached to fore and aft end portions of said upper deck for temporarily supporting the latter above said launch deck such as to allow the launch deck to be removed from beneath said upper deck for transport purposes;

(e) said outrigger legs being extendible and retractable such that after removal of the launch deck, and on retraction thereof, said upper deck may be lowered onto a suitable transport device, and, following transport to a desired location, the outrigger legs may be extended to raise said upper deck thus allowing said launch deck to be relocated therebeneath and reconnected in said spaced relation thereto.

20. The transportable launch vehicle of claim 19 wherein said support columns are detachable from said upper and launch decks respectively to permit ready transport of said decks.

21. The transportable launch vehicle of claim 19 wherein said launch deck is provided with detachable wheel and axle sets to permit the launch deck to be towed away from beneath the upper deck.

22. A method of conversion between transport and operating modes of a transportable launch vehicle for a highwall miner of the type having multiple elongated conveyor cars that may be connected together to form a conveyor train, wherein said launch vehicle comprises an elongated launch deck for receiving and supporting a conveyor car which is to be added or removed from an end of the conveyor train when in operation, and an upper equipment deck fixed, in use, in spaced relation above said launch deck; said method comprising:

(a) providing fore and aft pairs of extendable and retractable outrigger legs at fore and aft end portions of said upper deck for temporarily supporting the latter above said launch deck;

(b) disconnecting the upper deck from the launch deck;

(c) removing the launch deck from beneath said upper deck for transport purposes when said legs are in an extended condition;

(d) retracting said outrigger legs to lower said upper deck downwardly onto a suitable transport device;

(e) transporting said decks to a desired location;

(f) extending said outrigger legs to raise said upper deck; and (g) positioning said launch deck beneath said upper deck and reconnecting the decks in said spaced relation.

23. The method of claim 22 wherein said outrigger legs are removed after step (d) and reattached after step (e).

24. The method of claim 23 including providing said launch deck with detachable wheel and axle sets to permit the launch deck to be towed away from beneath the upper deck.

25. The method of claim 24 wherein said wheel and axle sets are removed from said launch deck following step (g).

* * * * *

UNITED STATES PATENT AND TRADEMARK OFFICE

CERTIFICATE OF CORRECTION

PATENT NO. : 6,652,035 B2
DATED : November 25, 2003
INVENTOR(S) : John W. Chisholm It is certified that error appears in the above-identified patent and that said Letters Patent is hereby corrected as shown below:

Drawings,
Sheet 2, Fig. 2, the reference numeral “52” (applied to HYD.PUMP) should read -- 57 --
Sheet 2, Fig. 2, the reference numeral “52” (applied to TANK) should read -- 53 --
Sheet 2, Fig. 2, the reference numeral “54” (applied to CONVEYOR CABLE REEL) should read -- 55 --

Column 13,
Line 37, "thereof and" should read -- and --

Column 14,
Line 48, "cuffing" should read -- cutting --

Signed and Sealed this

Twenty-fourth Day of August, 2004

JON W. DUDAS
*Director of the United States Patent and Trademark Office*